US009598092B2

(12) United States Patent
James et al.

(10) Patent No.: US 9,598,092 B2
(45) Date of Patent: Mar. 21, 2017

(54) RAILCAR ENERGY ABSORPTION/COUPLING SYSTEM

(71) Applicants: Kenneth A. James, West Chicago, IL (US); Erich A. Schoedl, Yorkville, IL (US)

(72) Inventors: Kenneth A. James, West Chicago, IL (US); Erich A. Schoedl, Yorkville, IL (US)

(73) Assignee: MINER ENTERPRISES, INC., Geneva, IL (US)

( * ) Notice: Subject to any disclaimer, the term of this patent is extended or adjusted under 35 U.S.C. 154(b) by 198 days.

(21) Appl. No.: 14/540,209

(22) Filed: Nov. 13, 2014

(65) Prior Publication Data

US 2016/0137212 A1 May 19, 2016

(51) Int. Cl.
*B61G 7/10* (2006.01)
*B61G 11/00* (2006.01)
(Continued)

(52) U.S. Cl.
CPC ..... *B61G 7/10* (2013.01); *B61G 9/04* (2013.01); *B61G 9/06* (2013.01); *B61G 11/00* (2013.01)

(58) Field of Classification Search
CPC ... B61G 1/00; B61G 7/00; B61G 7/08; B61G 7/10; B61G 7/12; B61G 7/14;
(Continued)

(56) References Cited

U.S. PATENT DOCUMENTS 461,443 A 10/1891 Miner
1,064,666 A 6/1913 O'Connor
(Continued)

OTHER PUBLICATIONS

Cardwell Westinghouse Company; Tandem Arrangement of Mark 50 and Mark 80 friction draft gear; Car Builders' Cyclopedia, 1961.
(Continued)

*Primary Examiner* — R. J. McCarry, Jr.
(74) *Attorney, Agent, or Firm* — Law Office of John W. Harbst

(57) ABSTRACT

A railcar energy absorption/coupling system including a cushioning assembly arranged in operable combination with a coupler and a yoke. The cushioning assembly is positioned in a draft pocket defined by a draft sill on a railcar between the front and rear stops. The yoke consists of a back wall along with top and bottom walls which are joined to and axially extending from the back wall toward a forward end of the cushioning assembly. The back wall of the yoke is disposed to contact the rear end of the cushioning assembly. The top and bottom walls of the yoke are operably coupled to a shank portion of the coupler toward a forward end of the yoke. The top and bottom walls of the yoke each include stop members which extend in opposed lateral directions from each other and limit draft travel while maximizing buff travel and limit total combined travel of the energy absorption/coupling system. The energy absorption/coupling system has a neutral position, a full buff position disposed a first predetermined distance from the neutral position, and a full draft position disposed a second predetermined distance from the neutral position, with the full buff and full draft positions for the energy absorption coupling system being disposed in opposite directions from the neutral position.

36 Claims, 17 Drawing Sheets

(51) Int. Cl.
*B61G 9/04* (2006.01)
*B61G 9/06* (2006.01)

(58) Field of Classification Search
CPC ... B61G 9/00; B61G 9/02; B61G 9/04; B61G 9/06; B61G 9/08; B61G 9/12; B61G 9/14; B61G 9/16; B61G 11/00; B61G 11/02; B61G 11/08; B61G 11/10; B61G 11/14
See application file for complete search history.

(56) References Cited

U.S. PATENT DOCUMENTS

| | | | | |
|---|---|---|---|---|
| 1,968,789 | A | 7/1934 | Townsend | |
| 2,197,030 | A | 4/1940 | Clark | |
| 2,553,636 | A | 5/1951 | Dath | |
| 2,650,720 | A | 9/1953 | Danielson | |
| 2,776,057 | A | 1/1957 | Blattner | |
| 2,859,883 | A | 11/1958 | Fumiss | |
| 2,918,182 | A | 12/1959 | Conner et al. | |
| 3,159,283 | A | 12/1964 | Peterson | |
| 3,160,285 | A | 12/1964 | Sinclair et al. | |
| 3,185,317 | A | 5/1965 | Willison | |
| 3,246,770 | A | 4/1966 | Gierlach | |
| 3,637,088 | A | 1/1972 | Bremond | |
| 3,840,126 | A | 10/1974 | Domer | |
| 5,176,268 | A | 1/1993 | Manley | |
| 5,305,899 | A | 4/1994 | Kaufhold | |
| 5,593,051 | A | 1/1997 | Openchowski | |
| 7,264,130 | B2 | 9/2007 | Sommerfeld et al. | |
| 8,070,002 | B2 * | 12/2011 | Meyer | B61G 9/22 213/24 |
| 8,096,432 | B2 | 1/2012 | Sprainis et al. | |

OTHER PUBLICATIONS

International Searching Authority; International Search Report regarding International PCT patent application PCT/US2015/060456; Jan. 28, 2016; two (2) pages.
International Searching Authority; Written Report of the International Searching Authority regarding International PCT patent application PCT/US2015; 060456; Jan. 28, 2016; four (4) pages.

* cited by examiner

RAILCAR ENERGY ABSORPTION/COUPLING SYSTEM

FIELD OF THE INVENTION DISCLOSURE

The present invention disclosure generally relates to railroad cars and, more specifically, to a railcar energy absorption/coupling system for absorbing both buff and draft forces normally encountered by railcars during make-up and operation of a train consist.

BACKGROUND

During the process of assembling or "making-up" a train consist, railcars are run into and collide with each other to couple them together. Since time is money, the speed at which the railcars are coupled has significantly increased. Moreover, and because of their increased capacity, railcars are heavier than before. These two factors and others have resulted in increased damages to the railcars when they collide and, frequently, to the lading carried within such railcars.

As railroad car designer/builders have reduced the weight of their designs, they have also identified a need to protect the integrity of the railcar due to excessive longitudinal loads being placed thereon, especially as the railcars are coupled to each other. Whereas, such longitudinal loads frequently exceed the design loads set by the AAR. Providing an energy absorption/coupling system at opposed ends of each railcar has long been known in the art. Such a system typically includes a draft assembly comprised of a coupler for releasably attaching two railcars to each other and a cushioning assembly arranged in operable combination with each coupler for absorbing and returning energy imparted thereto during make-up of the train consist and during in-service operation of the railcar.

In-service train action events and impacts occurring during the "make-up" of a train consist subject the draft assembly at opposed ends of the railcars to buff impacts, and in-service train action events subject the draft assembly to draft impacts. The impacts associated with these events are transmitted from the couplers to the respective cushioning assembly and, ultimately, to the railcar body. That is, as the couplers are pushed or pulled, be it during in-service operations and/or during the "make-up" of a train consist, such movements, although muted to some degree by the cushioning assembly, are translated to the railcar body.

Typically, draft assemblies further include a yoke that is operably coupled to the coupler as through a pin or key, a follower, and the cushioning assembly. Generally, the follower is positioned against or arranged closely adjacent to the butt or rear end of a shank portion on the coupler in the draft pocket and within confines defined by the yoke. The cushioning assembly is positioned between the follower and rear stops on the draft sill.

In buff events, the rear or butt end of the coupler moves axially inward against the follower and toward rear stops on the draft sill. As the coupler and follower move rearward, a portion of the shock or impact event is absorbed and dissipated by the cushioning assembly.

In draft events, slack between adjacent railcars is taken up beginning at the end of the train and ending at the other end of the train. As a result of the slack being progressively taken up, the speed difference between the railcars increases as the slack inherent with each energy absorption/coupling system at each end of the railcar in the train consist is taken up, with the resultant increase in buff and draft impacts on the energy absorption/coupling system. For example, when a locomotive on a train consist of railcars initially begins to move from a stopped or at rest position, there may be 100 inches of slack between the 50 pairs of energy absorption/coupling systems. This slack is taken up progressively by each pair of joined energy absorption/coupling systems in the train consist. After the slack in the energy absorption/coupling system joining the last railcar to the train consist is taken up, the next to the last railcar may be moving at 4 miles per hour. Given the above, it will be appreciated, the slack in the energy absorption/coupling system of those railcars closest to the locomotive is taken up very rapidly and those two railcars closest to the locomotive are subjected to a very large impact event being placed thereon. Such large impact events are capable of damaging the lading in the railcars.

Moreover, most of today's railcars use and embody air brakes. Such air brakes require an air hose to extend between railcars. While bridging the distance between adjacent railcars, the length of such air hoses is limited unless two or more air hoses are coupled to each other whereby adding to the overall cost. Of course, if the distance between the railcars exceeds the length of the air hose, the air hoses will separate from each other thereby affecting control over the braking function. Accordingly, there is a need to limit coupler travel in draft whereby limiting the distance between railcars during in-service operation of the train consist.

Thus, there is a continuing need and desire for a railcar energy absorption/coupling system which is capable of limiting the travel of the system during operation of the railcar in both buff and draft directions.

SUMMARY

According to one aspect of this invention disclosure, there is provided a railcar energy absorption/coupling system including an axially elongated draft sill defining a draft pocket between front stops and rear stops on the draft sill. To allow adjacent railcars to be releasably coupled to each other, the railcar energy absorption/coupling system also includes a coupler having a head portion and shank portion. As is typical, the head portion of the coupler axially extends beyond one end of the draft sill. A cushioning assembly is provided in operable combination with the coupler for absorbing and returning energy. The cushioning assembly is positioned in the draft pocket between the front and rear stops.

A yoke also forms part of the energy absorption/coupling system of this invention disclosure. The yoke consists of a back wall, a top wall joined to and axially extending from the back wall toward an open forward end, and a bottom wall joined to and axially extending from the back wall toward the open forward end of the yoke. The back wall of the yoke is disposed to contact the rear end of the cushioning assembly. The top and bottom walls of the yoke are operably coupled to the shank portion of the coupler toward the forward end of the yoke. A coupler follower is positioned between a free end of the shank portion of the coupler and a forward end of the cushioning assembly.

One of the salient features of this invention disclosure involves providing each of the top and bottom walls of the yoke with two forward facing stop members which extend in opposed lateral directions from each other. The two forward facing stop members on the top wall of the yoke are arranged in generally coplanar relation with the two forward facing stop members on the bottom wall of the yoke. Suffice it to say, the energy absorption/coupling system has a neutral position, a full buff position disposed a first predetermined distance from the neutral position, and a full draft position disposed a second predetermined distance from the neutral position, with the full buff and full draft positions for the energy absorption coupling system being disposed in opposite directions from the neutral position. When the energy absorption/coupling system of this invention disclosure is in a full buff position, a rear end of the cushioning assembly is positioned against the rear stops on the draft sill. Whereas, when the energy absorption/coupling system of this invention disclosure is in a full draft position, the stop members on the yoke operably engage with the forward stops on the draft sill.

According to this aspect of the invention disclosure, the draft pocket defined by the draft sill has a length of about 24.625 inches between confronting surfaces on the front and rear stops. Preferably, the coupler follower includes a forward facing surface which is biased into contacting relation with the front stops on the draft sill by the draft gear when the yoke is in the neutral position. In one form of the invention disclosure, the first predetermined distance traveled by the system is generally equal to the second predetermined distance traveled by the system. In one embodiment, each railcar energy absorption/coupling system will have a total combined travel in both buff and draft directions of about 6.5 inches. Advantageously, and if the yoke should fail or otherwise break, the stops on the yoke guard against adjacent railcars from becoming inadvertently separated from each other. Preferably, the stop members are formed integral with the top and bottom walls of the yoke.

In one embodiment, the cushioning assembly forming part of the energy absorbing/coupling system includes a railcar draft gear assembly including a walled housing. Preferably, the housing of the draft gear has a closed end and an open end.

According to another aspect of this invention disclosure, there is provided a railcar energy absorption/coupling system including an axially elongated draft sill defining a draft pocket between front stops and rear stops on the draft sill. The railcar energy absorption/coupling system also includes a coupler having a head portion and shank portion, with the head portion of the coupler axially extending beyond the draft sill.

In this alternative embodiment, the railcar energy absorption/coupling system includes a first cushioning assembly arranged in the draft pocket on the draft sill for absorbing and returning energy imparted thereto. This alternative embodiment of the energy absorption/coupling system, also includes a second cushioning assembly arranged in the draft pocket on the draft sill in axially aligned relation with the first cushioning assembly for absorbing and returning energy imparted thereto.

A yoke also forms part of the energy absorption/coupling system of this invention disclosure. The yoke consists of a back wall, a top wall joined to and axially extending from the back wall toward an open forward end, and a bottom wall joined to and axially extending from the back wall toward the open forward end, with the back wall of the yoke being disposed to contact a rear end of the second cushioning assembly, and with the top and bottom walls of the yoke being operably coupled to the shank portion of the coupler toward a forward end of the yoke.

In this family of embodiments, a coupler or first follower is positioned between a free end of the shank portion of the coupler and a forward end of the first cushioning assembly. A second or rear follower is disposed between a rear end of the first cushioning assembly and a forward end of the second cushioning assembly.

One of the salient features of this invention disclosure involves having each of the top and bottom walls of the yoke define two forward facing stop members which extend in opposed lateral directions from each other. The two forward facing stop members on the top wall of the yoke are arranged in generally coplanar relation with the two forward facing stop members on the bottom wall of the yoke. The second embodiment of the energy absorption/coupling system has a neutral position, a full buff position disposed a first predetermined distance from the neutral position, and a full draft position disposed a second predetermined distance from the neutral position, with the full buff and full draft positions for the energy absorption coupling system being disposed in opposite directions from the neutral position. When the energy absorption/coupling system of this invention disclosure is in a full buff position, a rear end of the second cushioning assembly is positioned against the rear stops on the draft sill. Whereas, when the energy absorption/coupling system of this invention disclosure is in a full draft position, the stop members on the yoke operably engage with the forward stops on the draft sill.

Preferably, the draft pocket defined by the draft sill in this second embodiment of the invention disclosure has a length of about 49.25 inches between confronting surfaces on the front and rear stops. In this embodiment, the coupler follower includes a forward facing surface which is biased into contacting relation with the front stops on the draft sill by the first and second draft gears when the yoke is in the neutral position. So as to enhance the absorption capacity of the system, the yoke will have a total combined travel in both buff and draft directions of about 10.0 inches. In operation, the stop members on the yoke are preferably designed to allow more buff travel than draft travel by limiting the draft travel and additionally preventing potential separation of the coupler from the draft sill. Preferably, the stop members are formed integral with the top and bottom walls of the yoke.

In one form, the first cushioning assembly includes a draft gear assembly having a walled housing. In one form, the second cushioning assembly includes a draft gear assembly having a walled housing. In both instances, the walled housing of each draft gear assembly preferably has a closed end and an open end. In all instances, draft gears, buffers and/or other forms of cushioning unit systems are used in pocket locations described by draft gear assemblies in the present invention disclosure.

According to another aspect of this invention disclosure, there is provided a railcar energy absorption/coupling system including an axially elongated draft sill defining a draft pocket between front stops and rear stops on the draft sill. To allow adjacent railcars to be releasably coupled to each other, the railcar energy absorption/coupling system also includes a coupler having a head portion and shank portion. As is typical, the head portion of the coupler axially extends beyond one end of the draft sill. A cushioning assembly is provided in operable combination with the coupler for absorbing and returning energy. The cushioning assembly is positioned in the draft pocket between the front and rear stops. In this embodiment of the invention disclosure, the cushioning assembly includes a walled housing.

A yoke also forms part of the energy absorption/coupling system of this invention disclosure. The yoke consists of a back wall, a top wall joined to and axially extending from the back wall toward an open forward end, and a bottom wall joined to and axially extending from the back wall toward the open forward end of the yoke. The back wall of the yoke is disposed to contact the rear end of the cushioning assembly. The top and bottom walls of the yoke are operably coupled to the shank portion of the coupler toward the forward end of the yoke. The top and bottom walls of the yoke embrace the housing of the cushioning assembly therebetween. A coupler follower is positioned between a free end of the shank portion of the coupler and a forward end of the cushioning assembly.

In this alternative embodiment, the top and bottom walls of the yoke each have two forward facing stop members which extend in opposed lateral directions from each other. The two forward facing stop members on the top wall of the yoke are arranged in generally coplanar relation with the two forward facing stop members on the bottom wall of the yoke. Suffice it to say, the energy absorption/coupling system has a neutral position, a full buff position disposed a first predetermined distance from the neutral position, and a full draft position disposed a second predetermined distance from the neutral position, with the full buff and full draft positions for the energy absorption coupling system being disposed in opposite directions from the neutral position. When the energy absorption/coupling system of this invention disclosure is in a full buff position, the rear end of the cushioning assembly is positioned against the rear stops on the draft sill. Whereas, when the energy absorption/coupling system of this invention disclosure is in a full draft position, the stop members on the yoke operably engage with the forward stops on the draft sill. With this invention disclosure, the draft travel of the energy absorption/coupling system is independently controlled relative to buff travel of the energy absorption/coupling system and is regulated as a function of the location of the four stop members on the yoke.

According to this alternative aspect of the invention disclosure, the draft pocket defined by the draft sill has a length of about 24.625 inches between confronting surfaces on the front and rear stops. Preferably, the coupler follower includes a forward facing surface which is biased into contacting relation with the front stops on the draft sill by the draft gear when the yoke is in the neutral position. In this form of the invention disclosure, the first predetermined distance traveled by the system is generally equal to the second predetermined distance traveled by the system. In this alternative embodiment, each railcar energy absorption/coupling system will have a total combined travel in both buff and draft directions of about 6.5 inches. Advantageously, and if the yoke should fail or otherwise break, the stops on the yoke guard against adjacent railcars from becoming inadvertently separated from each other. Preferably, the stop members on the yoke are formed integral with the top and bottom walls of the yoke.

According to another aspect of this invention disclosure, there is provided a railcar energy absorption/coupling system including an axially elongated draft sill defining a draft pocket between front stops and rear stops on the draft sill. To allow adjacent railcars to be releasably coupled to each other, the railcar energy absorption/coupling system also includes a coupler having a head portion and shank portion. As is typical, the head portion of the coupler axially extends beyond one end of the draft sill. A cushioning assembly is provided in operable combination with the coupler for absorbing and returning energy. The cushioning assembly is positioned in the draft pocket between the front and rear stops A yoke also forms part of the energy absorption/coupling system of this invention disclosure. The yoke consists of a back wall, a top wall joined to and axially extending from the back wall toward an open forward end, and a bottom wall joined to and axially extending from the back wall toward the open forward end of the yoke. The back wall of the yoke serves to operably interconnect the top and bottom walls of the yoke. The top and bottom walls of the yoke are operably coupled to the shank portion of the coupler toward the forward end of the yoke. A coupler follower is positioned between a free end of the shank portion of the coupler and a forward end of the cushioning assembly.

In this alternative embodiment, the top and bottom walls of the yoke each have two forward facing stop members which extend in opposed lateral directions from each other. The two forward facing stop members on the top wall of the yoke are arranged in generally coplanar relation with the two forward facing stop members on the bottom wall of the yoke. Suffice it to say, the energy absorption/coupling system has a neutral position, a full buff position disposed a first predetermined distance from the neutral position, and a full draft position disposed a second predetermined distance from the neutral position, with the full buff and full draft positions for the energy absorption coupling system being disposed in opposite directions from the neutral position. The stop members on the yoke are operably engaged with the forward stops on said sill when the energy absorption/coupling system is in the full draft position, With this aspect of the invention disclosure, the draft travel of the energy absorption/coupling system is independently controlled relative to buff travel of the energy absorption/coupling system and is regulated as a function of the location of the four stop members on the yoke.

According to this alternative aspect of the invention disclosure, the coupler follower includes a forward facing surface which is biased into contacting relation with the front stops on the draft sill when the yoke is in the neutral position. In this form of the invention disclosure, the first predetermined distance traveled by the system is generally equal to the second predetermined distance traveled by the system. Advantageously, and if the yoke should fail or otherwise break, the stops on the yoke guard against adjacent railcars from becoming inadvertently separated from each other. Preferably, the stop members on the yoke are formed integral with the top and bottom walls of the yoke. Moreover, and in this embodiment of the invention disclosure, the stops on the yoke are arranged in generally coplanar relationship relative to the top and bottom walls on the yoke.

DETAILED DESCRIPTION

Figure 1:
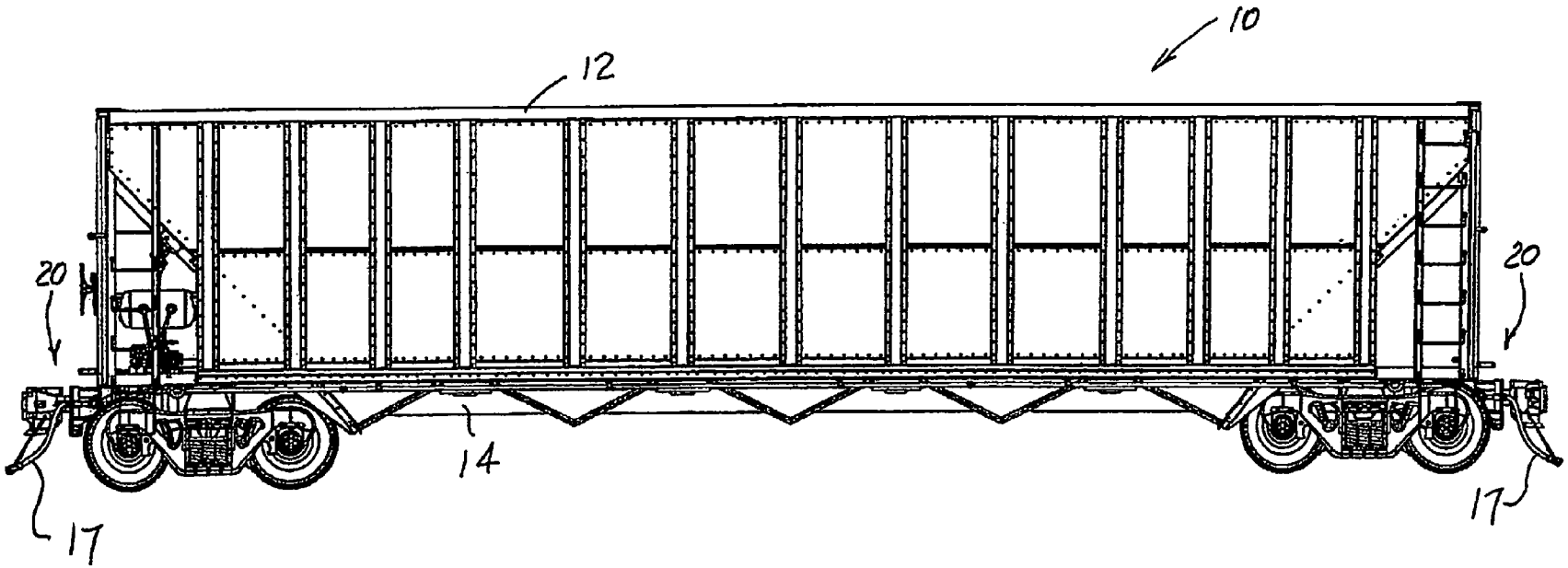
FIG. 1 is a side view of a railcar embodying principals and teachings of the present invention disclosure.

While this invention disclosure is susceptible of embodiment in multiple forms, there is shown in the drawings and will hereinafter be described preferred embodiments, with the understanding the present disclosure is to be considered as setting forth exemplifications of the disclosure which are not intended to limit the disclosure to the specific embodiments illustrated and described.

Referring now to the drawings, wherein like reference numerals indicate like parts throughout the several views, there is shown in FIG. 1 a railroad car, generally indicated by reference numeral 10. Although a railroad freight car is illustrated in the drawings for exemplary purposes, it will be appreciated the teachings and principals of this invention disclosure relate to a wide range of railcars including but not limited to railroad freight cars, tank cars, railroad hopper cars, and etc. Suffice it to say, railcar 10 has a railcar body 12, in whatever form, supported on a draft sill or centersill 14 (FIG. 2) defining a longitudinal axis 16 (FIG. 2) for and extending substantially the length of railcar 10. Railcar 10 includes a conventional brake system which is preferably operated by air. In this regard, and as known in the art, air hoses 17 extend from opposite ends of the car and operably connect with air hoses from an axially adjacent railcar after the cars are coupled in a train consist relative to each other.

As shown in FIG. 1, an energy absorption/coupling system, generally identified by reference numeral 20, and embodying teachings and principals of this invention disclosure is provided toward opposed ends of the railcar 10. In a preferred embodiment, and to reduce costs, the energy absorption/coupling system provided toward opposed ends of the railcar 10 are substantially identical and, thus, are both identified by reference numeral 20.

Figure 2:
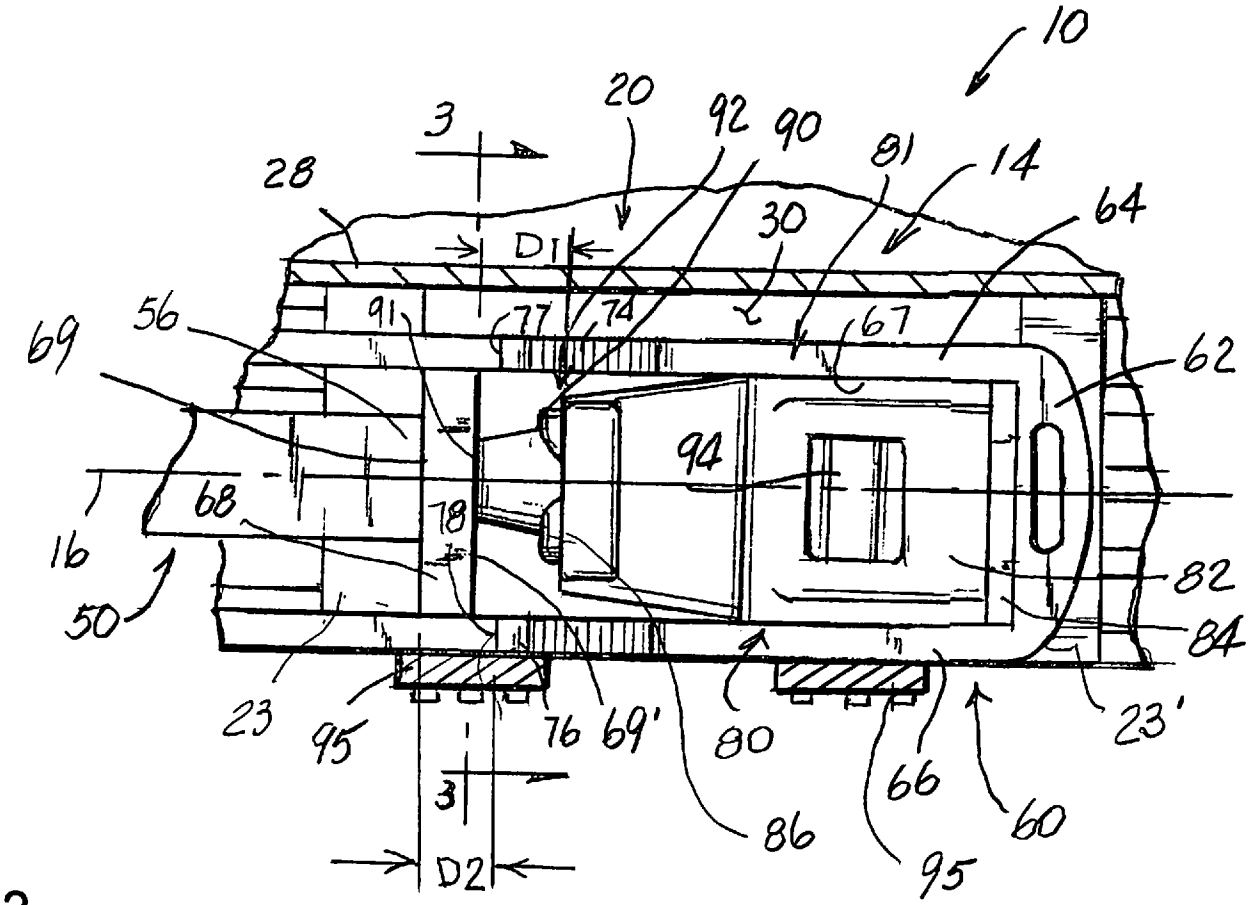
FIG. 2 is an enlarged fragmentary longitudinal sectional view of a portion of one embodiment of an energy absorption/coupling system embodying principals and teachings of this invention disclosure.
Figure 3:
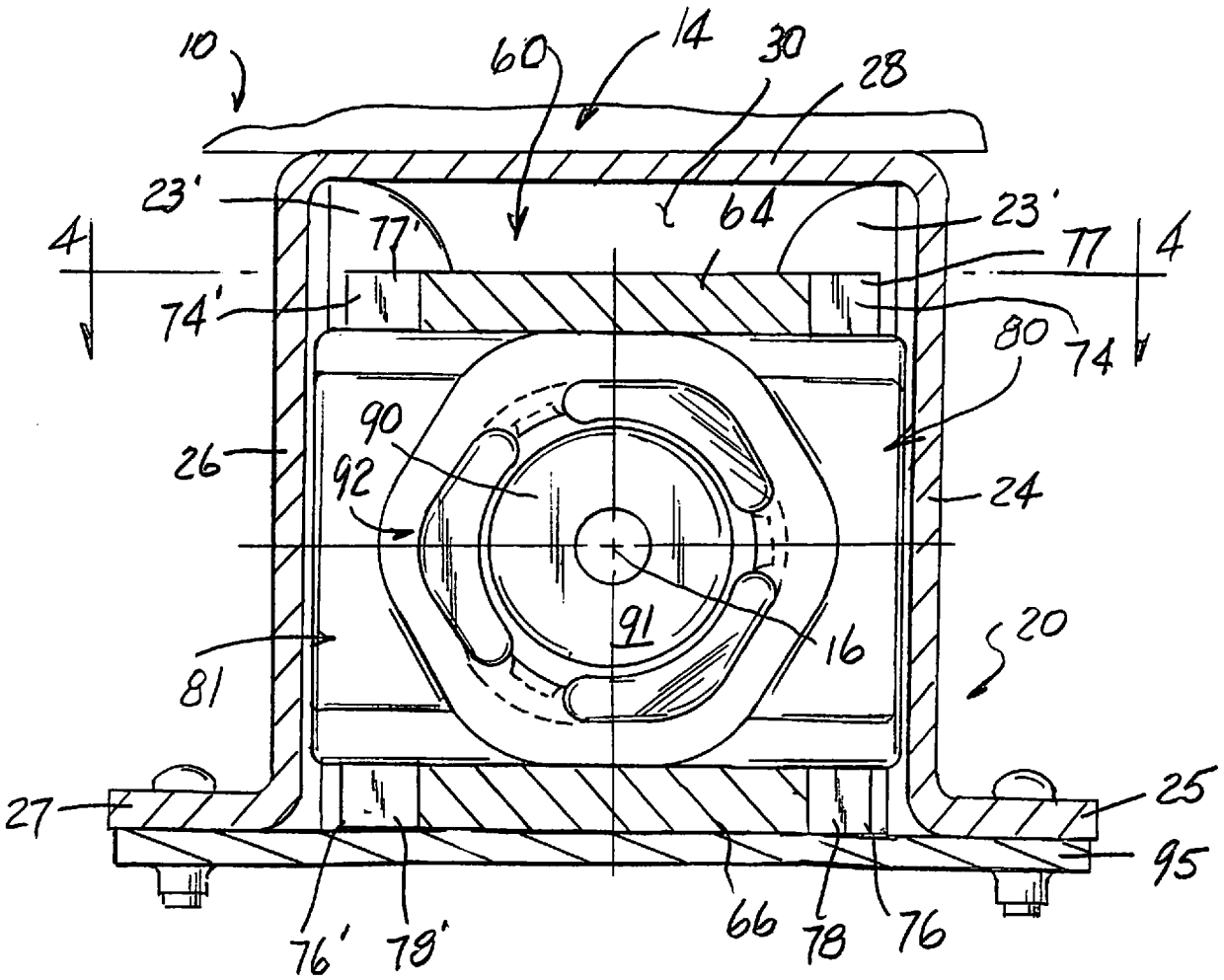
FIG. 3 is a sectional view taken along line 3-3 of FIG. 2.

The draft sill or centersill 14 shown by way of example in FIG. 2 can be cast or fabricated and has standard features. In the embodiment shown in FIG. 2, and toward each end thereof, the centersill 14 has stops including laterally spaced front stops 23 and laterally spaced rear stops 23' connected to laterally spaced walls 24 and 26 of the centersill 14 (FIG. 3). The front and rear stops 23 and 23', respectively, are longitudinally spaced apart from each other. In a preferred embodiment, the front and rear stops 23 and 23', respectively, extend the full height of the draft sill or centersill 14.

In the embodiment shown in FIG. 3, the centersill 14 also has a top wall 28, although it will be appreciated the present invention disclosure is equally applicable to and can be used with a draft sill lacking such a top wall. Returning to FIG. 2, the stops 23, 23' on the centersill 14 combine to define a draft gear pocket 30 therebetween. The centersill 14 can have other standard features and is preferably made of standard materials in standard ways. The energy absorption/coupling system 20 of this invention disclosure may advantageously be used with either cast or fabricated draft sills. In the first embodiment of the invention disclosure, the draft gear pocket, i.e., the longitudinal distance between the inboard faces of the front stops 23 and the inboard faces of the rear stops 23', measures 24.625 inches.

Figure 4:
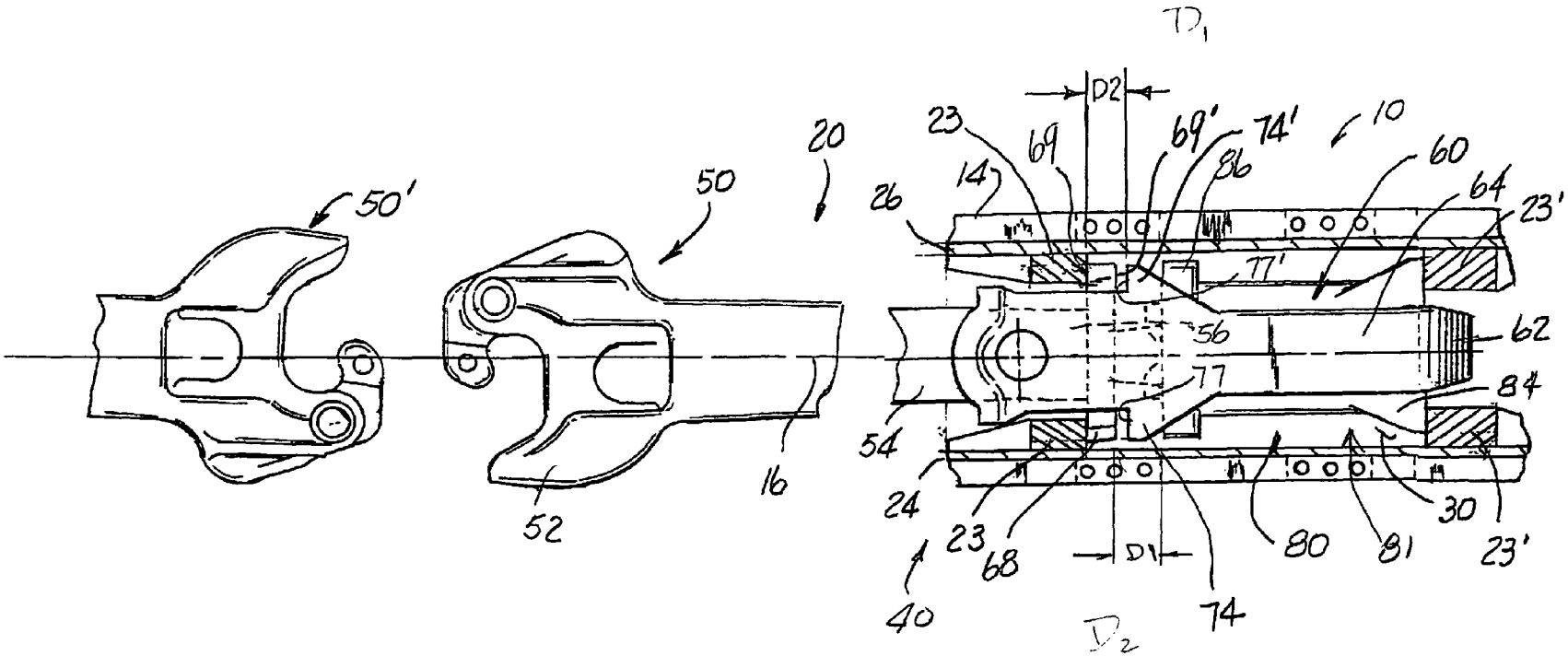
FIG. 4 is a sectional view taken along line 4-4 of FIG. 3 showing the first embodiment of the energy absorption/coupling system in a neutral position.
Figure 5:
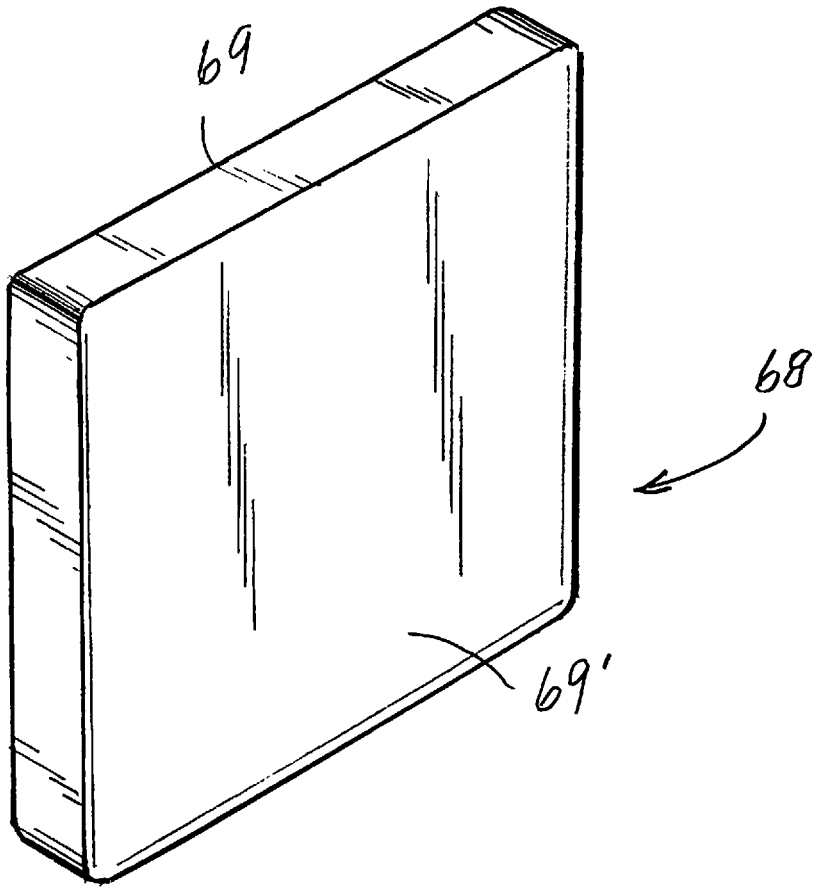
FIG. 5 is a perspective view of one element of the energy absorption/coupling system shown in FIGS. 2 and 3.

As shown in FIG. 4, each energy absorption/coupling system 20 has a draft assembly 40 primarily including a standard coupler 50 and a cushioning assembly 80 disposed in longitudinally disposed and operable combination relative to each other. The standard coupler 50 of each draft assembly 40 includes a head portion 52 and shank portion 54, preferably formed as a one-piece casting. As is typical, the coupler head portion 52 extends longitudinally outward from the centersill 14 to engage a similar coupler 50' extending from an end of a second and adjacent railcar to be releasably coupled or otherwise connected to car 10. In operation, the shank portion 54 is guided for generally longitudinal movements by the centersill 14 of the railcar 10.

Preferably, each draft assembly 40 furthermore includes a yoke 60 which, in one form, comprises a steel casting or it can be fabricated from separate steel components. In the embodiment illustrated by way of example in FIG. 4, yoke 60 is configured for use with a standard F coupler but it will be appreciated with slight redesign efforts known to those skilled in the art, the teachings and principals of this invention disclosure equally apply to a yoke which is configured for use with a standard E coupler without detracting or departing from the novel spirit and broad scope of this invention disclosure.

As shown in FIG. 2, yoke 60 has a sideways inverted generally U-shaped configuration including back wall 62, an axially elongated top wall 64 joined to and axially extending from the back wall 62 toward the forward end of the cushioning assembly 80 and an elongated bottom wall 66 joined to and axially extending from the back wall 62 toward the forward end of the cushioning assembly 80. As known, the top wall 64 and bottom wall 66 of yoke 60 extend generally parallel and are separated from each other to define a linearly unobstructed chamber 67 (FIG. 2) which readily accommodates the cushioning assembly 80 therein (FIG. 3). In the illustrated embodiment, the top and bottom walls 64 and 66, respectively, of yoke 60 embrace the cushioning assembly 80 therebetween and allow for endwise sliding movements of the cushioning assembly relative thereto. As shown in FIG. 2, the yoke 60 is configured such that the back wall 62 of the yoke 60 presses against and pushes the cushioning assembly 80 forward during a draft operation of the energy absorption/coupling system 20. Toward a forward end thereof, and after other components of the draft assembly 40 are arranged in operable combination relative to each other, as discussed below, yoke 60 is operably coupled to the shank portion 54 of coupler 50 as by a key or pin.

The cushioning assembly 80 of each energy absorption/coupling system 20 is installed in general alignment with the longitudinal axis 16 between the stops 23, 23' for absorbing and dissipating both buff and draft dynamic impact forces (loads), axially applied to the draft assembly 40 during make-up of a train consist and in-service operations of such a train consist. As will be appreciated by those skilled in the art, the cushioning assembly 80 can take on any of a myriad of different designs and different operating characteristics without seriously departing or detracting from the true spirit and novel concept of this invention disclosure. For example, the cushioning assembly 80 illustrated in the drawings can include a draft gear assembly designated by reference numeral 81 which can be accommodated in a conventionally sized draft gear pocket. The draft gear assembly 81 can be of the type manufactured and sold by Miner Enterprises, Inc. of Geneva, Ill. under Model No. TF-880 or Model No. Crown SE or any other equivalent and conventional draft gear assembly.

Suffice it to say, the essential elements of the draft gear assembly 81 include: a hollow metallic housing 82 having a closed rear end 84 and an open forward end 86 and series of walls 88 extending between the ends 84 and 86, a spring biased linearly reciprocal wedge member 90 forming part of a friction clutch assembly 92, and a spring assembly 94 which, in the illustrated embodiment, is operably positioned within the draft gear assembly housing 82. In the embodiment shown by way of example in FIG. 3, the top and bottom walls 64 and 66, respectively, of the yoke 60 embrace the housing 82 of draft gear assembly 81 therebetween. As shown in FIG. 2, a free end 91 of the wedge member 90 typically extends a predetermined distance D1 past the open end 86 of the housing 82 when the yoke 60 is in a neutral position. In the embodiment illustrated by way of example in FIGS. 2 and 4, the free end 91 of the wedge member 90 axially extends about 3.25 inches beyond the open end of the draft gear housing 82 when the yoke 60 is in a neutral position. In the illustrated embodiment, the draft gear assembly 81 is designed to both consistently and repeatedly withstand impact events directly axially theretoward.

In the embodiment shown by way of example in FIGS. 2 and 4, each draft assembly 40 furthermore includes a coupler follower 68 disposed between an inner or free end 56 of the shank portion 54 of coupler 50 and the cushioning assembly 80. In one embodiment, the follower 68 is movable between the top wall 64 and bottom wall 66 of the associated yoke 60 in a forward and rearward longitudinal direction. The coupler follower 68 has a forward facing generally flat first surface 69 which engages with the free end 56 of the shank portion 54 of coupler 50 and a second rear facing generally flat second surface 69' which engages with the forward end of the cushioning assembly 80. In the embodiment illustrated by way of example in FIGS. 2 and 4, and when the cushioning assembly 80 includes a draft gear assembly, the coupler follower 68 is arranged in operable combination with and presses against the free end of the wedge member 90 of the draft gear assembly 81 when the energy absorption/coupling system 20 is installed in the centersill or draft sill 14. Preferably, the faces 69 and 69' of the coupler follower 68 are generally parallel relative to each other. In an alternative form, the forward facing first surface 69 of the coupler follower 68 can have a contoured/concave recess (not shown) for accommodating the free end 56 of the shank portion 54 of coupler 50 without detracting or departing from the true spirit and broad scope of this invention disclosure.

With the present invention disclosure, the cushioning assembly 80 of each system 20 can be relatively easily installed in the pocket 30 using standard and well known installation procedures and in operable combination with the coupler 50. In the illustrated embodiment, and after the draft gear assembly 81 is in place in the centersill 14, standard support members 95 (FIGS. 2 and 3) can be attached to flanges 25 and 27 on the centersill walls 24 and 26, respectively, to operably support the yoke 60 and draft gear assembly 81 within pocket 30 and in operable association with the coupler 50.

Turning again to FIG. 4, in this first illustrated embodiment, the top wall 64 of the yoke 60 has a pair of laterally spaced and laterally aligned stop members 74 and 74' which extend in opposed lateral directions from each other. In this first illustrated embodiment, the bottom wall 66 of the yoke 60 also has a pair of laterally spaced and laterally aligned stop members 76 and 76' (FIG. 3) which extend in opposed lateral directions from each other. In a preferred form, the stop members 74, 74' are formed integral with the top wall 64 of yoke 60 while the stop members 76, 76' are formed integral with the bottom wall 66 of yoke 60. The stop members 74, 74', 76 and 76' are arranged relative to each other to provide the yoke 60 with four co-planar forward-facing stopping surfaces 77, 77' and 78, 78'. As shown in the embodiment illustrated by way of example in FIG. 3, two stopping surfaces 77, 77' on the yoke 60 are disposed above the longitudinal axis 16 and in generally coplanar relationship with the top wall 64 of yoke 60 while two stopping surfaces on the yoke 60 are disposed below the longitudinal axis 16 and in generally coplanar relationship with the bottom wall 66 of the yoke 60. Moreover, two stopping surfaces 77 and 78 on the yoke 60 are preferably disposed to one lateral side of the longitudinal axis 16 while two additional stopping surfaces 77' and 78' are disposed to an opposed lateral side of the axis 16.

As shown in FIG. 2, the co-planar forward-facing stop surfaces 77, 77' and 78, 78' on the yoke 60 are disposed at a predetermined distance D2 from the confronting surface on the front stops 23 on the draft sill 14 when yoke 60 is in a neutral position. During draft travel, the co-planar forward-facing stop surfaces 77, 77' and 78, 78' on the yoke 60 will operably contact the front stops 23 on the draft sill 14 thereby limiting draft travel while also limiting compression of the cushioning assembly 80. In the illustrated embodiment, and during draft travel, the co-planar forward-facing stop surfaces 77, 77' and 78, 78' on the yoke 60 will contact the front stops 23 on the draft sill 14. Notably, and since they are formed as part of the yoke 60, the stop members 74, 74', 76 and 76' prevent potential separation of the coupler 50 from the draft gear sill 14 should a catastrophe occur regarding yoke 60. Preferably, and in the illustrated embodiment, the predetermined distance D2 the co-planar forward-facing stop surfaces 77, 77' and 78, 78' on the yoke 60 is disposed from the confronting surface on the front stops 23 on the draft sill 14 is about equal to or less than the predetermined distance D1 the free end of wedge member 90 axially extends beyond the open end 86 of the draft gear housing 82 when the energy absorption/coupling system 20 is in a neutral position.

Figure 6:
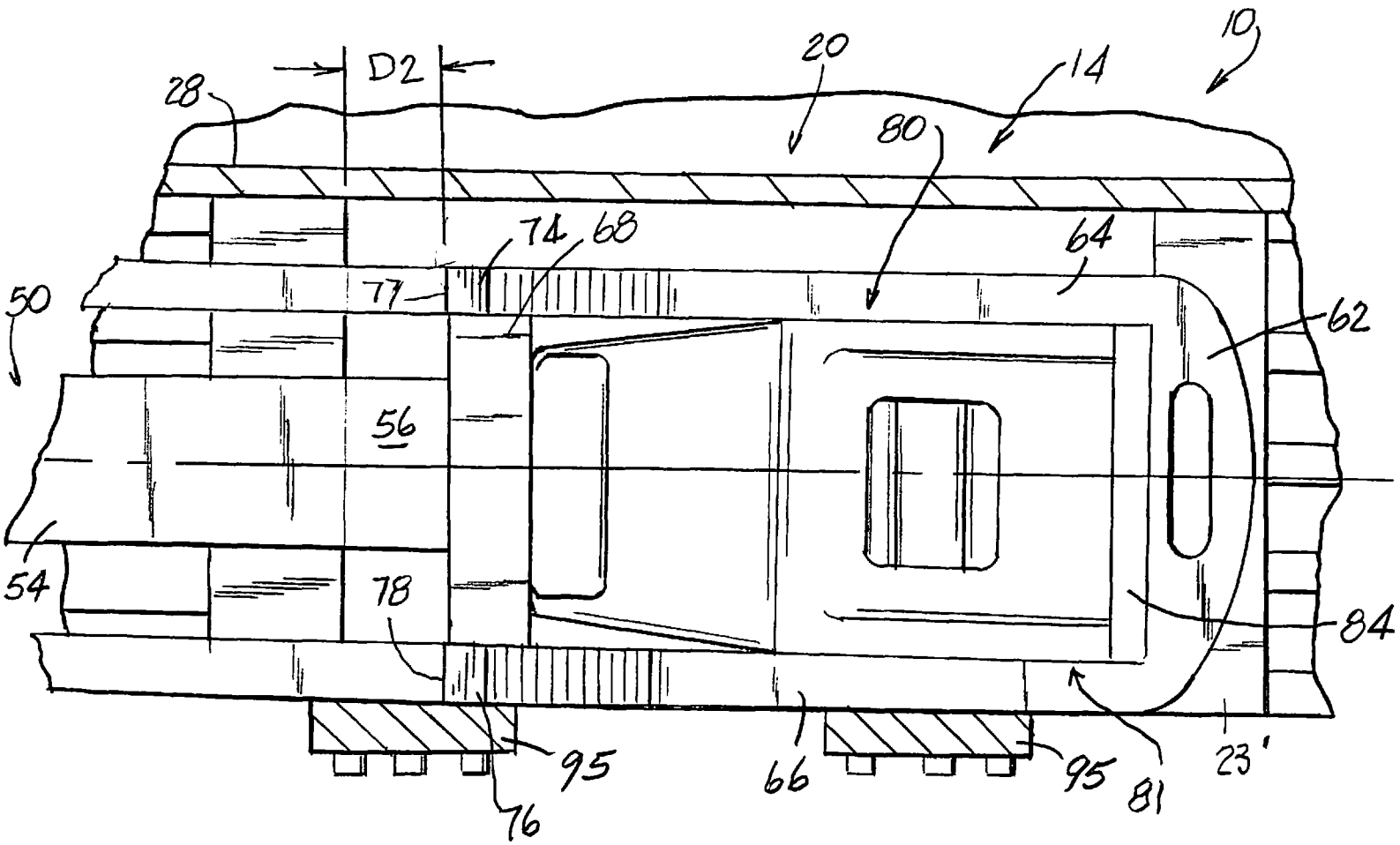
FIG. 6 is an enlarged view similar to FIG. 2 showing the energy absorption/coupling system in a full buff position.
Figure 7:
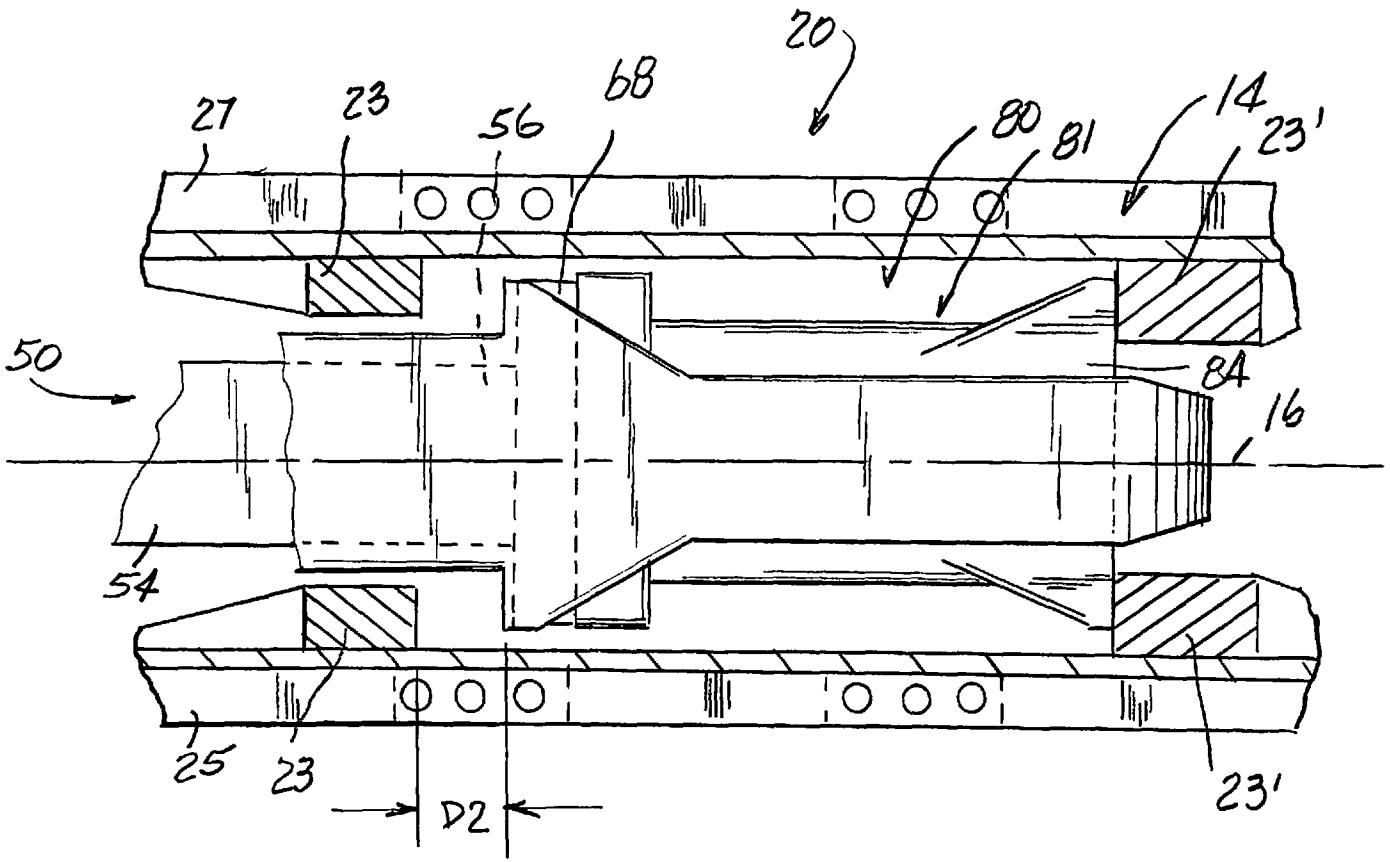
FIG. 7 is an enlarged view similar to FIG. 4 showing the energy absorption/coupling system in a full buff position.

As mentioned, FIGS. 2 and 4 show the energy absorption/coupling system 20 in a substantially neutral position. FIGS. 6 and 7 show the energy absorption/coupling system 20 in a full buff position. In the embodiment shown by way of example in FIGS. 6 and 7, the rear stops 23' on the centersill 14 allow the energy absorption/coupling system 20 to be disposed about 3.25 inches from the neutral position when in a full buff position with the rear end 84 of the draft gear housing 82 being positioned against the stops 23' on the draft gear sill 14. In the illustrated full buff position of the energy absorption/coupling system 20, the four co-planar forward-facing stopping surfaces 77, 77' and 78, 78' on the stop members 74, 74' and 76. 76', respectively, preferably extend at least the predetermined distance D2 from the front stop members 23 on the centersill 14.

Figure 8:
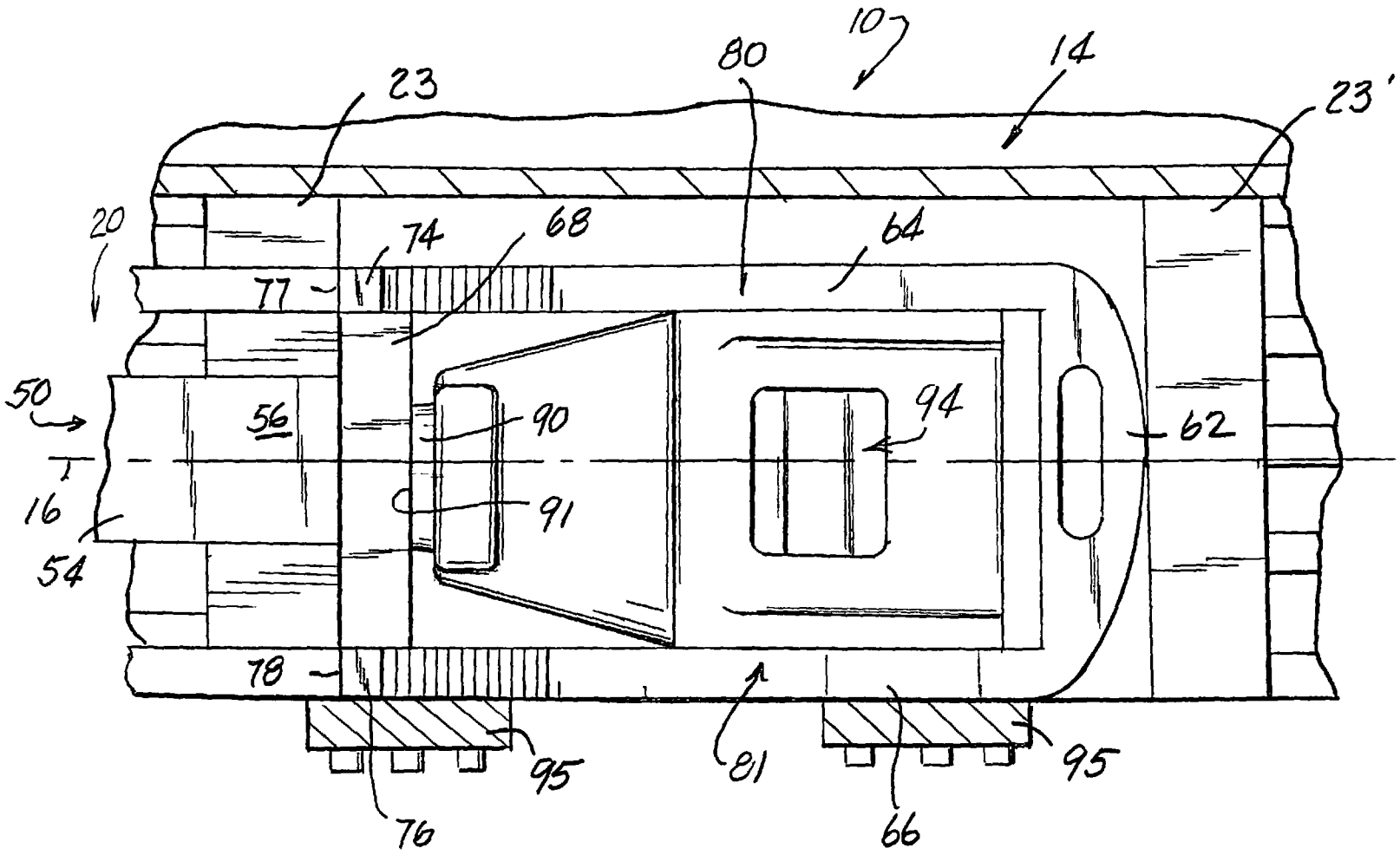
FIG. 8 is an enlarged view similar to FIG. 6 showing the energy absorption/coupling system in a full draft position.
Figure 9:
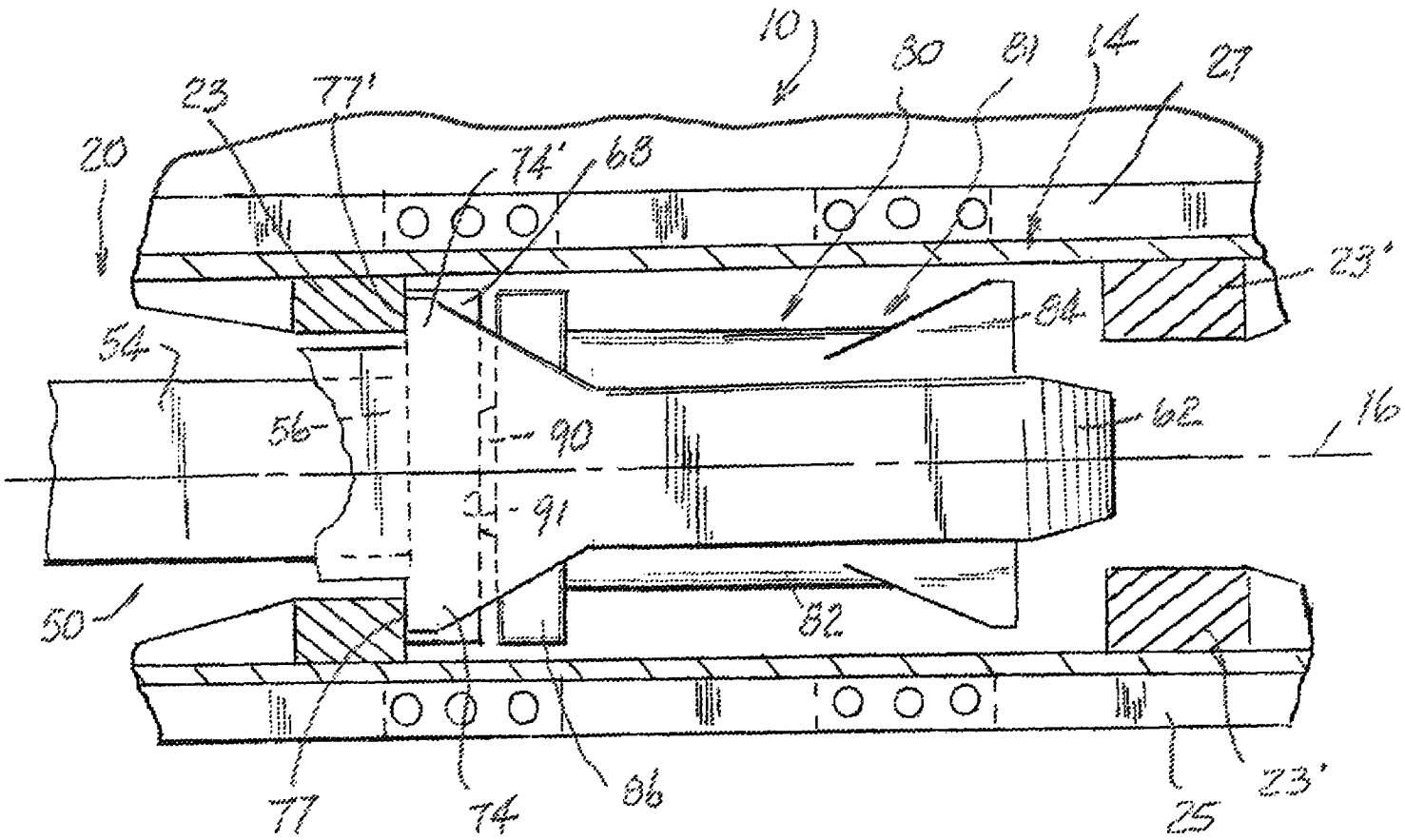
FIG. 9 is an enlarged view similar to FIG. 7 showing the energy absorption/coupling system in a full draft position.

FIGS. 8 and 9 show the energy absorption/coupling system 20 in a full draft position. In the full draft position, and in the embodiment illustrated by way of example in FIGS. 8 and 9, the yoke 60 is drawn to the left under the influence of the coupler 50. As the yoke 60 is drawn to the left under the influence of the coupler 50, the cushioning assembly 80 axially compresses. In the illustrated embodiment of the cushioning assembly 80, the spring assembly 94 (FIG. 8) of the draft gear assembly 81 is compressed by the wedge member 90 axially retracting within the housing as the free end 91 of the wedge member 90 presses against the coupler follower 68 which is halted from further movement to the left by the front stops 23.

In the full draft position of the energy absorption/coupling system 20, and in the embodiment illustrated, after the distance D2 (FIG. 7) is collapsed by movement of the yoke 60 to the left in FIGS. 8 and 9, the multiple co-planar forward-facing stopping surfaces 77, 77' and 78, 78' on the stop members 74, 74' and 76. 76', respectively, operably engage with the confronting surface on the front stops 23 whereby halting further movement of the yoke 60 toward the left. In the embodiment shown by way of example in FIGS. 8 and 9, the multiple co-planar forward-facing stopping surfaces 77, 77' and 78, 78' defined by the stop members 74, 74' and 76, 76', respectively, allow the yoke 60 to travel the distance D2 (FIGS. 6 and 7) from the neutral position to a full draft position. By halting further movements of the yoke 60, the stop members 74, 74' and 76, 76': 1) limit draft travel; 2) maximize buff travel; and, 3) limit total combined travel of the energy absorption coupling system 20 while furthermore preventing inadvertent separation of the railcars and unwarranted braking and/or separation of the air hoses 17 (FIG. 1).

In this first embodiment, the energy absorption/coupling system 20 will have a combined travel in both buff and draft directions of about 6.5 inches. It should be readily appreciated from the above disclosure, however, the travel of the yoke 60 during the draft operation of the energy absorption/coupling system 20 can be modified to change the combined travel in both buff and draft directions to less than 6.5 inches simply by relocating the multiple co-planar forward-facing stopping surfaces 77, 77' and 78, 78' defined by the stop members 74, 74' and 76, 76' from that disclosed without detracting or departing from the true sprit and novel concept of this invention disclosure.

An alternative embodiment of an energy absorption/coupling system is illustrated in FIGS. 10 through 18. This alternative embodiment of an energy absorption/coupling system is designated generally by reference numeral 120. Those elements of this alternative embodiment of an energy absorption/coupling system that are functionally analogous to those components discussed above regarding the energy absorption/coupling system 20 are designated by reference numerals identical to those listed above with the exception this alternative embodiment uses reference numerals in the 100 series.

Figure 10:
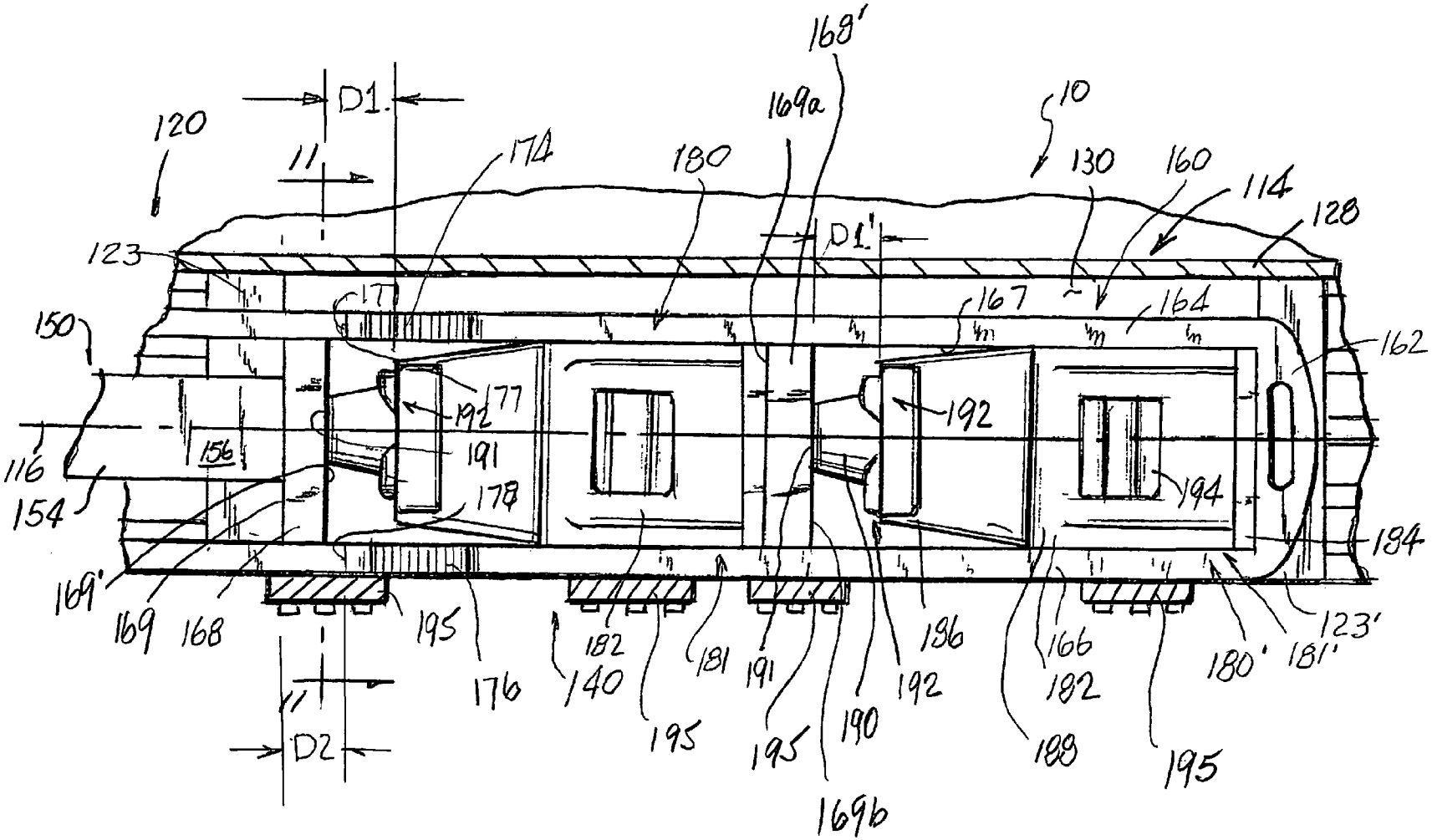
FIG. 10 is an enlarged fragmentary longitudinal sectional view of a portion of a second embodiment of an energy absorption/coupling system embodying principals and teachings of this invention disclosure.

In the alternative embodiment illustrated in FIG. 10, and toward each end thereof, the centersill 114 has stops including laterally spaced front stops 123 and laterally spaced rear stops 123' connected to laterally spaced walls 124 and 126 of the centersill 114. The front and rear stops 123 and 123', respectively, are longitudinally spaced apart from each other. In this alternative embodiment, the front and rear stops 123 and rear stops 123' extend the full height of the draft sill or centersill 114.

Figure 11:
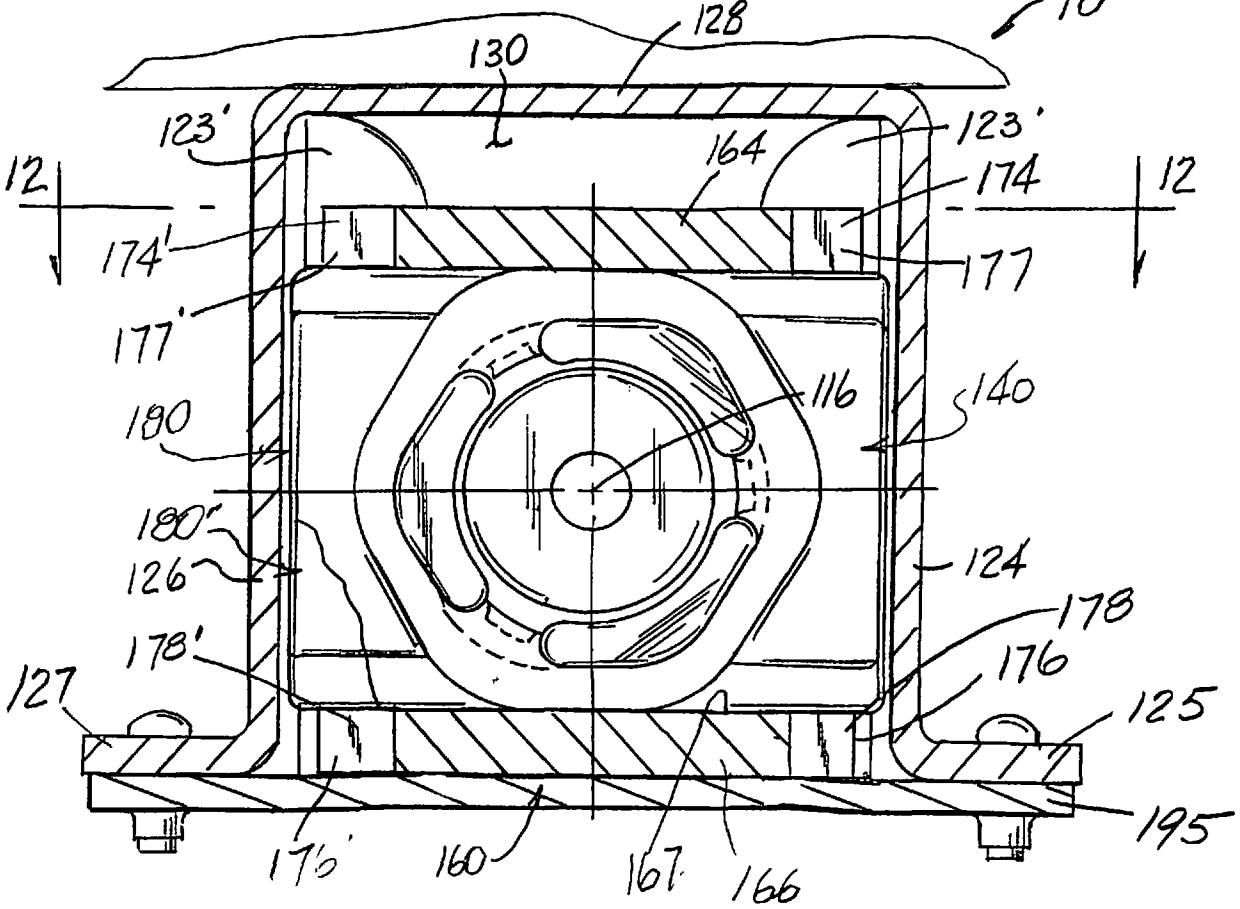
FIG. 11 is a sectional view taken along line 11-11 of FIG. 10.

In the embodiment shown in FIG. 11, the centersill 114 also has a top wall 128, although it will be appreciated the present invention disclosure is equally applicable to and can be used with a draft sill lacking such a top wall. Suffice it to say, the stops 123, 123' (FIG. 12) on the centersill 114 combine to define an axially elongated draft gear pocket 130 therebetween. The centersill 114 can have other standard features and is preferably made of standard materials in standard ways. The energy absorption/coupling system 120 of this invention disclosure may advantageously be used with either cast or fabricated draft sills. In this second embodiment of the invention disclosure, the draft gear pocket 130, i.e., the longitudinal distance between the inboard faces of the front stops 123 and the inboard faces of the rear stops 123', measures 49.25 inches.

Each energy absorption/coupling system 120 has a draft assembly 140 primarily including a standard coupler 150 along with first and second cushioning assemblies 180 and 180' arranged in axially aligned relation relative to each other and disposed in longitudinally disposed and operable combination relative to each other. As such, the tandem cushioning assembly arrangement illustrated in this alternative embodiment of the energy absorption/coupling system permits the first and second cushioning assemblies 180 and 180' to operate in series relative to each other during both buff and draft operations and to increase the capacity and capability of each energy absorption/coupling system 120 on the railcar to absorb and dissipate impact loads directed thereto.

The standard coupler 150 of each draft assembly 140 includes a head portion 152 and shank portion 154, preferably formed as a one-piece casting. As is typical, the coupler head portion 152 extends longitudinally outward from the centersill 114 to engage a similar coupler 150' (FIG. 12) extending from an end of a second and adjacent railcar to be releasably coupled or otherwise connected to railcar 10. In operation, the shank portion 154 is guided for generally longitudinal movements by the centersill 114 of the railcar 10.

Preferably, each draft assembly 140 furthermore includes a yoke 160 which, in one form, comprises a steel casting or it can be fabricated from separate steel components. In the embodiment illustrated by way of example in FIG. 12, yoke 160 is configured for use with a standard F coupler but it will be appreciated with slight redesign efforts known to those skilled in the art, the teachings and principals of this invention disclosure equally apply to a yoke which is configured for use with a standard E coupler without detracting or departing from the novel spirit and broad scope of this invention disclosure.

Figure 12:
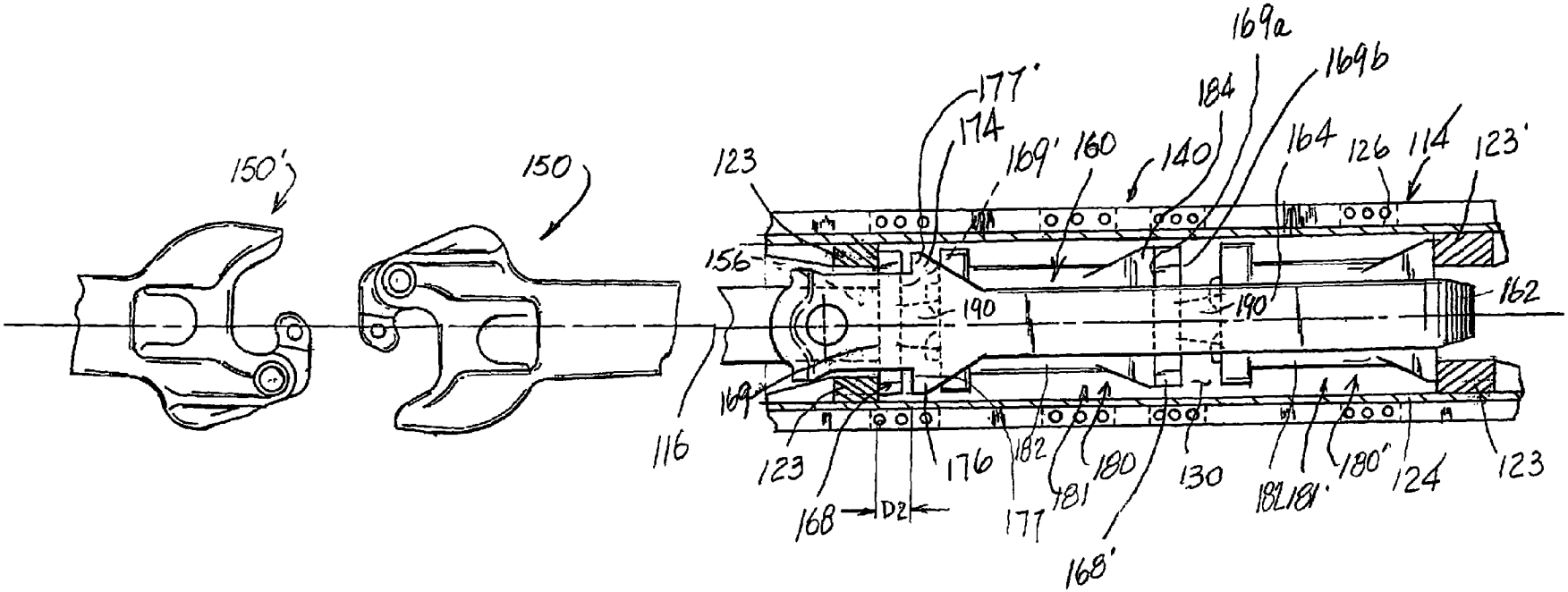
FIG. 12 is a sectional view taken along line 12-12 of FIG. 11 showing the second embodiment of the energy absorption/coupling system in a neutral position

Suffice it to say, yoke 160 has a sideways inverted generally U-shaped configuration including a back wall 162, a top wall 164 joined to and axially extending from the back wall 162 toward the forward end of the first cushioning assembly 180 and a bottom wall 166 joined to and axially extending from the back wall 162 toward the forward end of the first cushioning assembly 180. The top wall 164 and bottom wall 166 of yoke 160 extend generally parallel and are separated from each other to define a linearly unobstructed chamber 167 (FIG. 10) which readily accommodates the cushioning assembly 180 therein. In the illustrated embodiment, the top and bottom walls 164 and 166, respectively, of yoke 160 embrace both cushioning assemblies 180, 180' therebetween (FIG. 10) and allow for endwise sliding movements of the cushioning assemblies 180, 180' relative thereto. Notably, the top and bottom walls 164, 166 will be of sufficient length to also accommodate the added components of the energy absorption/coupling system 120. The yoke 160, when used with the tandem cushion assembly arrangement as shown in FIGS. 10 and 12, is configured to allow installation and removal of the component parts of the energy absorption/coupling system 120 relative to the draft gear sill 114 using standard well known installation procedures and in operable combination with coupler 150.

As shown in FIG. 10, and as discussed above regarding the energy absorption/coupling system 20, the yoke 160 is configured such that the back wall 162 presses against and pushes both cushioning assemblies 180, 180' forward during a draft operation of the energy absorption/coupling system 120. Toward a forward end thereof, and after other components of the draft assembly 140 are arranged in operable combination relative to each other, yoke 160 is operably coupled to the shank portion 154 of coupler 150 as by a key or pin.

Both cushioning assemblies 180, 180' of the second energy absorption/coupling system 120 are installed in general alignment with the longitudinal axis 116 between the stops 123, 123' for absorbing and returning both buff and draft dynamic impact forces (loads), axially applied to the draft assembly 140 during make-up of a train consist and in-service operations of such a train consist. As will be appreciated by those skilled in the art, the cushioning assemblies 180, 180' can either be the same or different from each other whereby allowing the energy absorption/coupling system 120 to be customized to a particular operation without seriously departing or detracting from the true spirit and novel concept of this invention disclosure.

In the embodiment illustrated in FIG. 10, and during operation of the second energy absorption/coupling system 120, the cushioning assembly 180 can be axially compressed a predetermined distance D1. In the embodiment illustrated in FIG. 10, and during operation of the second energy absorption/coupling system 120, the cushioning assembly 180' can be axially compressed a predetermined distance D1'. In a most preferred form of the invention disclosure, and when D1 and D1' are cumulatively added to each other, the cushioning assemblies 180, 180' provide about 6.5 inches of axial travel to the coupler 150 as the second energy absorption/coupling system 120 moves from the neutral position to the full buff position.

Although illustrated as having similar designs, it should be appreciated the cushioning assemblies 180, 180' can take on any of a myriad of different designs relative to each other and each cushioning assembly can have different operating characteristics from the other without seriously detracting or departing from the true spirit and scope of this invention disclosure. For example, the cushioning assembly 180 can include a conventional draft gear assembly designated generally by reference numeral 181. The draft gear assembly 181 can be of the type manufactured and sold by Miner Enterprises, Inc. of Geneva, Ill. under Model No. TF-880 or other equivalent type of cushioning assembly. Similarly, the other or second cushioning assembly 180' in the tandem cushioning assembly arrangement can include a conventional draft gear assembly designated generally by reference numeral 181'. Draft gear assembly 181' can be of the type manufactured and sold by Miner Enterprises, Inc. of Geneva, Ill. under Model No. TF-880 draft gear or, in the alternative, can be a Model Crown SE draft gear assembly sold by Miner Enterprises, Inc. or any equivalent cushioning assembly suitable to the particular needs of the railcar manufacturer.

The elements of each draft gear assembly 181, 181' shown by way of example as one form for cushioning assemblies 180, 180' are: a hollow metallic housing 182 having a closed rear end 184 and an open forward end 186 and wall structure 188 extending between the ends 184 and 186, a spring biased linearly reciprocal wedge member 190 forming part of a friction clutch assembly 192, and a spring assembly 194 which, in the illustrated embodiment, is operably positioned within the draft gear assembly housing 182 of each draft gear assembly 181, 181'. In the illustrated embodiment, each draft gear assembly 181. 181 is capable of consistently and repeatedly withstanding impact events directly axially theretoward. In the embodiment illustrated by way of example, the top and bottom walls 164 and 166, respectively, of the yoke 160 embrace the housings of each draft gear assembly 181, 181' therebetween.

In the embodiment of this invention disclosure illustrated by way of example in FIG. 10, and when the second energy absorption/coupling system 120 is in a neutral position, the free end 191 of draft gear assembly 181 axially projects forward from the draft gear housing 182 by the predetermined distance D1. Similarly, and in the embodiment of this invention disclosure illustrated by way of example in FIG. 10, when the second energy absorption/coupling system 120 is in a neutral position, the free end 191 of draft gear assembly 181' axially projects forward from the draft gear housing 182 by the predetermined distance D1'. In one form, the axial distances D1, D1' are substantially equal. As mentioned above, the axial distance D1 equals about 3.25 inches and the axial distance D1' equals about 3.25 inches.

Figure 13:
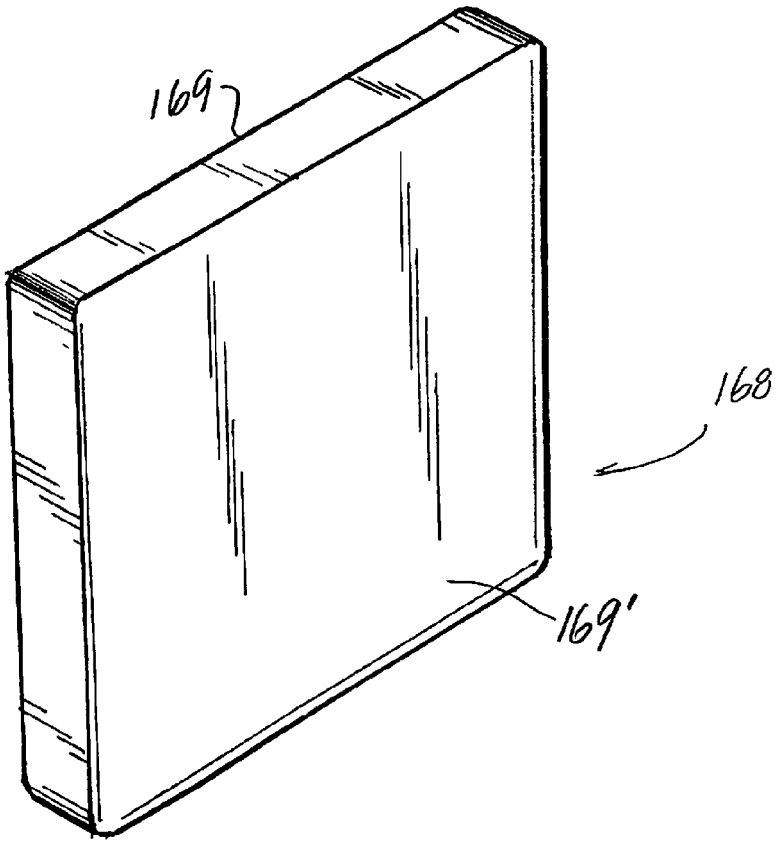
FIGS. 13 and 14 are perspective views of two elements of the energy absorption/coupling system shown in FIGS. 10 and 12.

In the embodiment shown by way of example in FIGS. 10 and 12, the draft assembly 140 furthermore includes a front coupler follower 168 disposed between an inner or free end 156 of the shank portion 154 of coupler 150 and the first cushioning assembly 180. In one embodiment, the follower 168 is movable between the top wall 164 and bottom wall 166 of the associated yoke 160 in a forward and rearward longitudinal direction. As shown in FIG. 13, the coupler follower 168 has a forward facing generally flat first surface 169 which engages with the free end 156 of the shank portion 154 of coupler 150 and a second rear facing generally flat second surface 169' which engages with the forward end of the first cushioning assembly 180. In the embodiment illustrated by way of example in FIGS. 10 and 12, and when the cushioning assembly 180 includes a draft gear assembly, the coupler follower 168 is arranged in operable combination with and presses against the free end of the wedge member 190 of the draft gear assembly 181 when the energy absorption/coupling system 120 is installed in the centersill 14. Preferably, the faces 169 and 169' of the coupler follower 168 are generally parallel relative to each other. In an alternative form, the forward facing surface 169 of the coupler follower 168 can have concave recess or contour (not shown) for accommodating the free end 156 of the shank portion 154 of coupler 150 without detracting or departing from the spirit and scope of this invention disclosure.

In the embodiment shown by way of example in FIGS. 10 and 12, the draft assembly 140 furthermore includes a second or rear coupler follower 168' disposed between the first and second cushioning assemblies 180 and 180', respectively. More specifically, and with respect to the illustrated embodiment, the second or rear coupler follower 168' is disposed between the rear end 184 of the first draft gear assembly 181 and the free end 191 of the wedge member 190 of the second draft gear assembly 181'. Like follower 168, the second or rear follower 168' is movable between the top wall 164 and bottom wall 166 of the associated yoke 160 in a forward and rearward longitudinal direction.

Figure 14:
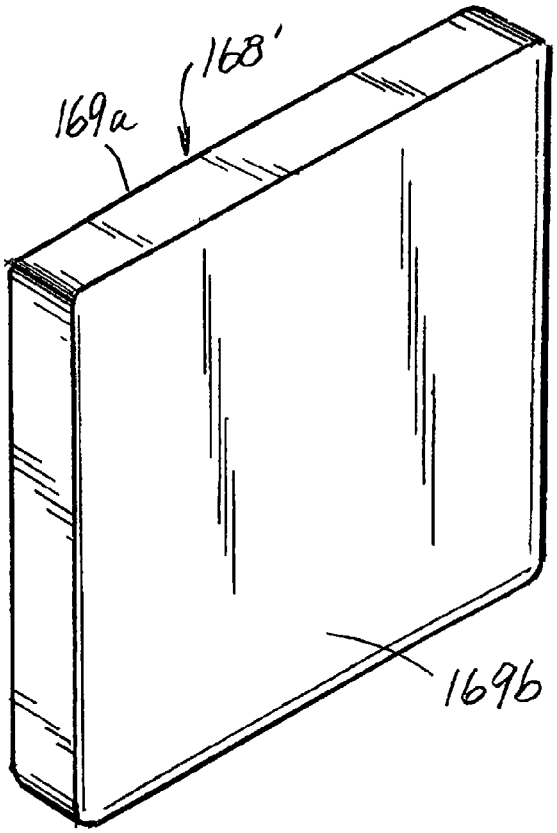

As shown in FIG. 14, the rear or second coupler follower 168' has a forward facing generally flat first surface 169*a* which engages with the rear end of the first cushioning assembly 180 and a second rear facing generally flat surface 169*b* which engages with the forward end of the second cushioning assembly 180'. In the embodiment illustrated by way of example in FIGS. 10 and 12, and when the cushioning assembly 180 includes a draft gear assembly, the front face 169*a* of the coupler follower 168' is arranged in operable combination with and presses against the rear end 184 of the draft gear assembly 181 and the surface 169*b* of the rear follower 168' presses against the free end 191 of the wedge member of rear draft gear assembly 181'. Preferably, the faces 169*a* and 169*b* of the second or rear follower 168' are generally parallel relative to each other.

With the present invention disclosure, the tandem cushioning assembly 180, 180' of each energy absorption/coupling system 120 can be relatively easily installed in operable combination with the respective coupler 150 using standard and well known installation procedures. That is, once each cushioning assembly 180, 180' is in place in the centersill 114, standard support members 195 (FIGS. 10 and 11) can be attached to flanges 125 and 127 on the walls 124 and 126, respectively, of sill 114 to operably support the yoke 160 and each cushioning assembly 180, 180' within pocket 130 and in operable association with the coupler 150.

In this second illustrated embodiment, the top wall 164 of the yoke 160 has a pair of laterally spaced and laterally aligned stop members 174 and 174' which extend in opposed lateral directions from each other. In this second illustrated embodiment, the bottom wall 166 of the yoke 160 has a pair of laterally spaced and laterally aligned stop members 176 and 176' which extend in opposed lateral directions from each other. In a preferred form, the stop members 174, 174' are formed integral with the top wall 164 of yoke 160 while the stop members 176, 176' are formed integral with the bottom wall 166 of yoke 160. The stop members 174, 174', 176 and 176' are arranged relative to each other to provide the yoke 160 with four co-planar forward-facing stop surfaces 177, 177' and 178, 178'. Preferably, two stopping surfaces 177, 177' on the yoke 160 are disposed above the longitudinal axis 116 while two stopping surfaces 178, 178' on the yoke 160 are disposed below the longitudinal axis 116. Moreover, two stopping surfaces 177 and 178 on the yoke 160 are preferably disposed to one lateral side of the longitudinal axis 116 while two additional stopping surfaces 177' and 178' are disposed to an opposed lateral side of the axis 116.

As shown in FIG. 10, the four co-planar forward-facing stop surfaces 177, 177' and 178, 178' on the yoke 160 are disposed at a predetermined distance D2 from the front stops 123 on the draft sill 114. During draft travel, the co-planar forward-facing stop surfaces 177, 177' and 178, 178' on the yoke 160 will operably contact the forward stops 123 on the draft sill 114 thereby limiting draft travel while maximizing buff travel and limiting total combined travel of the energy absorption coupling system 120 while furthermore preventing inadvertent separation of the railcars and unwarranted braking and/or separation of the air hoses 17 (FIG. 1). In the illustrated embodiment, and during draft travel, the co-planar forward-facing stop surfaces 177, 177' and 178, 178' on the yoke 160 will contact the front stops 23 on the draft sill 14.

Figure 15:
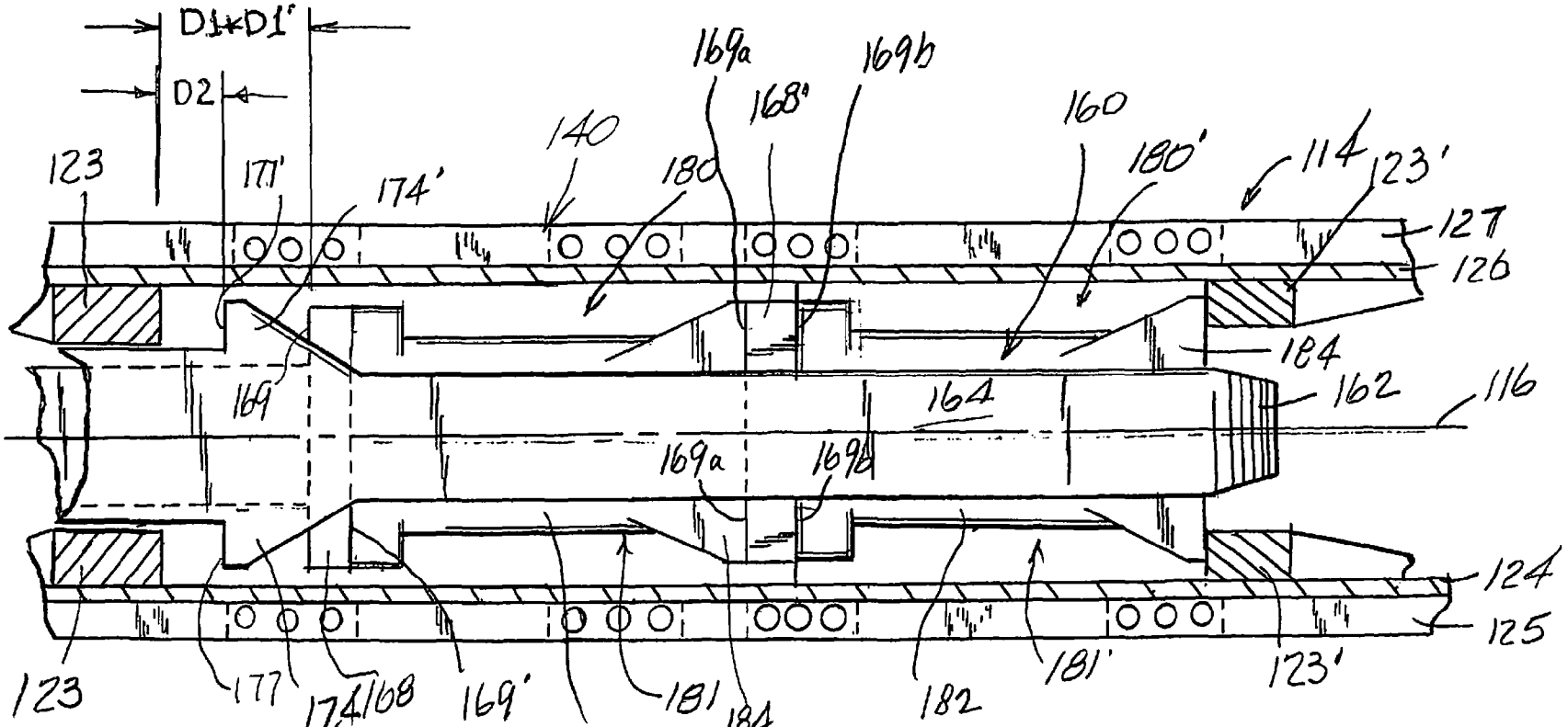
FIG. 15 is an enlarged view similar to FIG. 7 showing the second embodiment of the energy absorption/coupling system in a full buff position.
Figure 16:
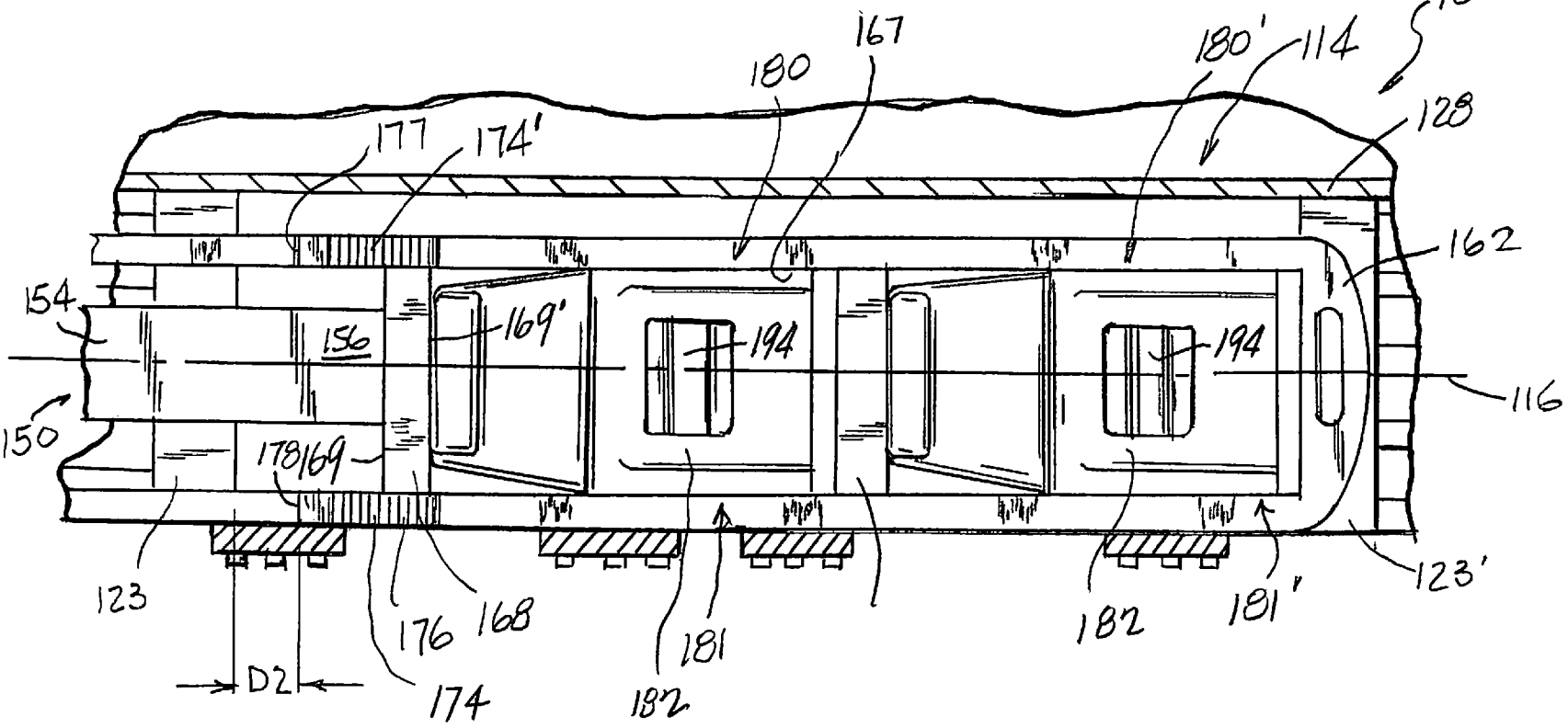
FIG. 16 is an enlarged view similar to FIG. 6 showing the second embodiment of the energy absorption/coupling system in a full buff position

FIGS. 10 and 12 show the second embodiment of the energy absorption/coupling system 120 in a substantially neutral position. FIGS. 15 and 16 show the second embodiment of the energy absorption/coupling system 120 in a full buff position. In the embodiment shown in FIGS. 15 and 16, the rear stops 123' on the centersill 114 maintain the yoke 160 in generally the same position as the yoke 160 was disposed when the energy absorption/coupling system 120 is disposed in a neutral position. That is, in the illustrated embodiment, and when the absorption/coupling system 120 is in a full buff position, the four co-planar forward facing stopping surfaces 177, 177' and 178, 178' on the stops 174, 174' and 176, 176', respectively, preferably extend at least the predetermined distance D2 from the front stop members 123 on the centersill 114.

In the full buff position of the second embodiment of the energy absorption/coupling system 120, the first and second cushioning assemblies 180 and 180', respectively, have been axially compressed by the coupler shank portion 154 having been forcibly moved to the right, as shown in FIGS. 15 and 16. In the illustrated embodiment, the first and second cushioning assemblies 180 and 180', respectively, are configured and designed to allow about 6.5 inches of combined axial compression.

In the illustrated embodiment shown in FIGS. 15 and 16, and as a result of the coupler shank portion 154 moving to the right, the first follower 168 presses against the draft gear assembly 180 whereby causing the wedge member 190 (FIG. 10) of draft gear assembly 180 to linearly retract into the housing 182. Because they are arranged in series relative to each other, and as a result of the coupler shank portion 154 moving to the right as shown in FIGS. 15 and 16, draft gear assembly 181 likewise presses against the wedge member 190 of draft gear assembly 181', as through the rear or second follower 168', whereby causing the wedge member 190 (FIG. 10) of draft gear assembly 181' to linearly retract into the housing 182 of draft gear assembly 181'. The linear retraction of the wedge members 190 of the draft gear assemblies 181, 181' is resisted by the friction clutch assembly 192 and spring assembly 194 of each draft gear assembly 181, 181' assembly. The linear retraction of the wedge members 190 (FIG. 10) into the housing 182 of each draft gear assembly 181, 181' continues until the coupler followers 168 and 168' abut against and engage with the respective draft gear housing 182 and, thereafter, impact forces are transferred to the stops 123'. Ultimately, during a buff operation of the second embodiment of the energy absorption/coupling system 120, the rear end 184 of the second draft gear assembly 181 engages with and transfers the buff forces of the coupler 150 to the draft gear sill 114.

Figure 17:
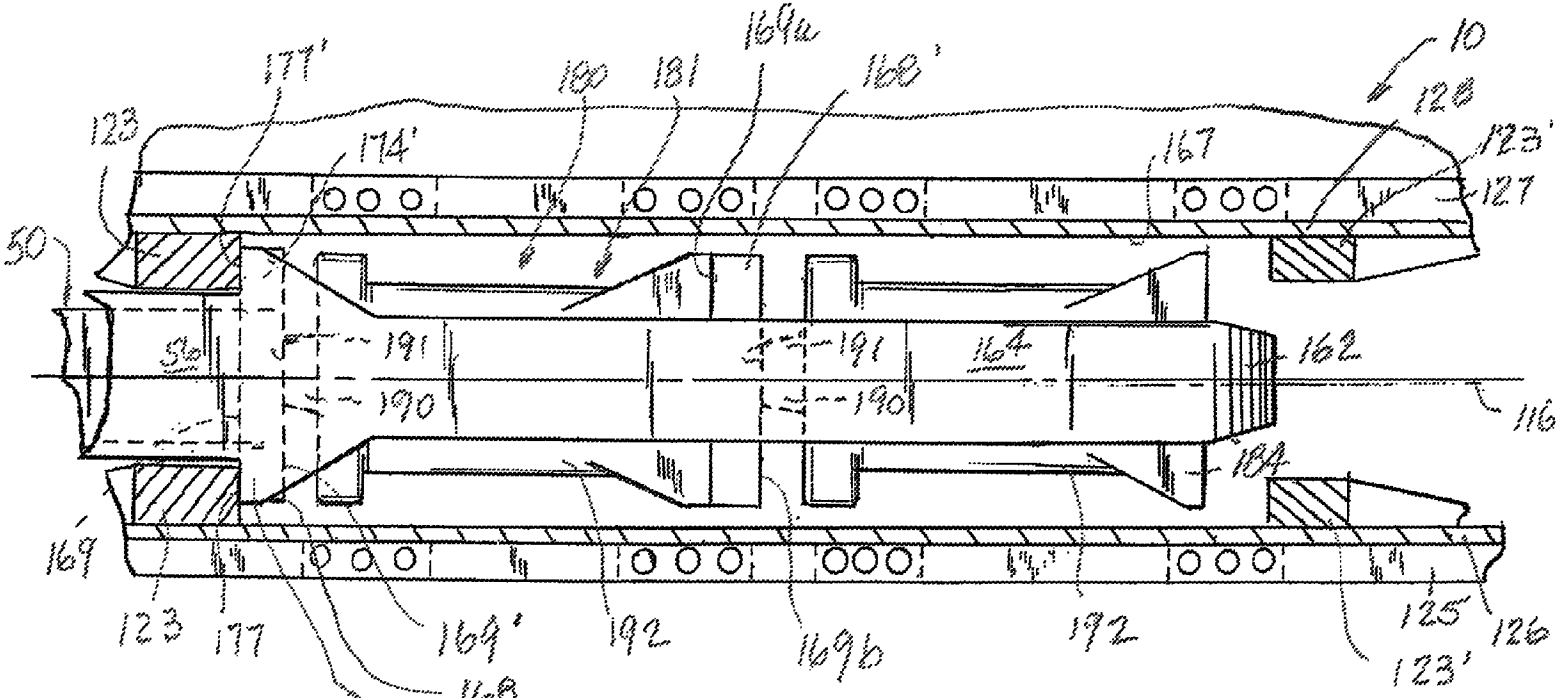
FIG. 17 is an is an enlarged view similar to FIG. 9 showing the second embodiment of the energy absorption/coupling system in a full or limited draft position.
Figure 18:
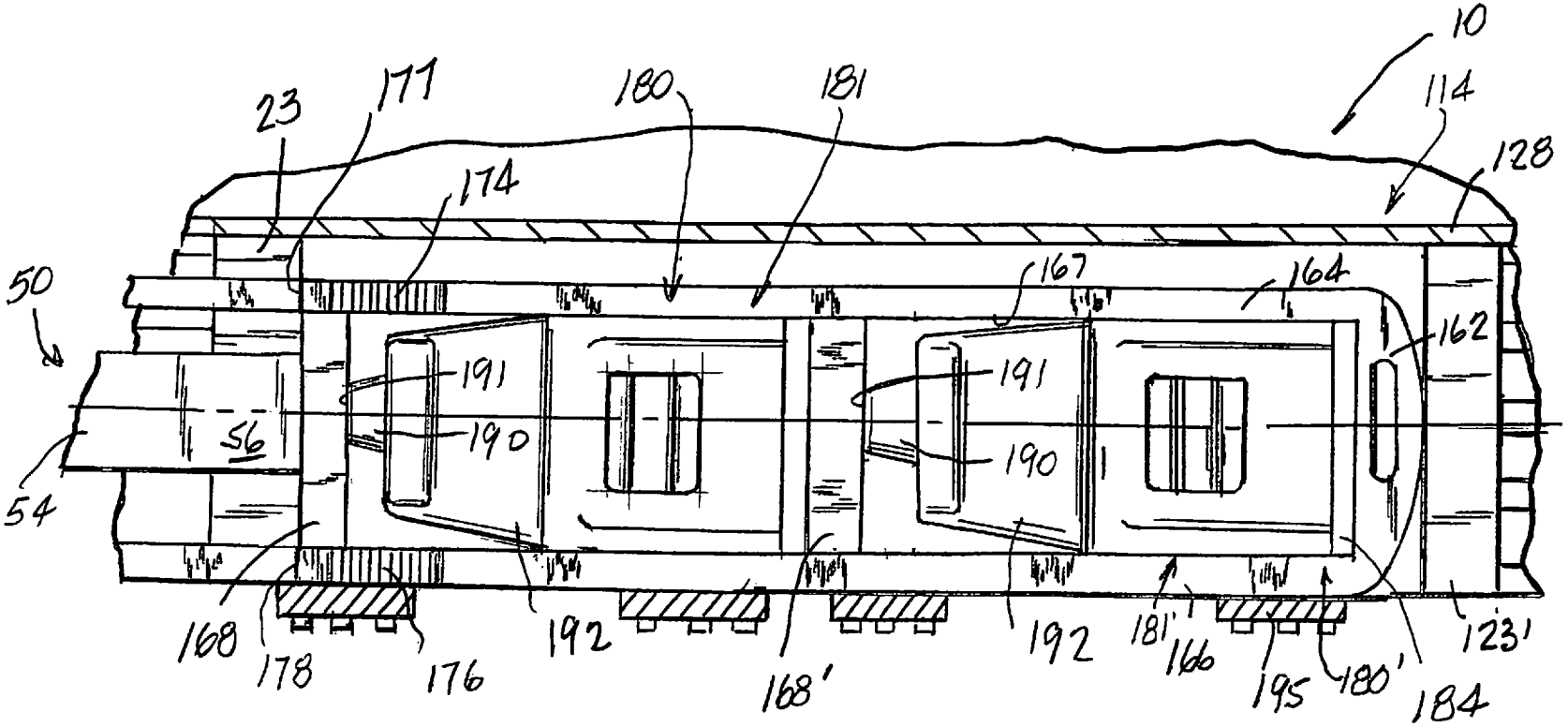
FIG. 18 is an enlarged view similar to FIG. 8 showing the second embodiment of the energy absorption/coupling system in a full or limited draft position.

FIGS. 17 and 18 show the second embodiment of the energy absorption/coupling system 120 in a full draft position as allowed by the absorption/coupling system design. In the full draft position, and in the embodiment illustrated by way of example in FIGS. 17 and 18, the yoke 160 is drawn to the left under the influence of the coupler 150 and away from the rear stops 123'. As the yoke 160 is drawn to the left under the influence of the coupler 150, the cushioning assemblies 180, 180' axially compress. In the illustrated embodiment of the cushioning assemblies 180, 180', the spring assemblies 194 of each draft gear assembly 181 are permitted to axially expand from the compressed position they were disposed when in the full buff position (FIGS. 15 and 16). As such, the free end 191 of the wedge member 190 of each draft gear assembly 181 and 181' axially projects beyond the respective draft gear housing 192 and resiliently presses against the respective follower 168, 168'.

In the full draft position of the energy absorption/coupling system 120, and after the distance D2 is collapsed by movement of the yoke 160 to the left as illustrated in FIGS. 17 and 18, the multiple co-planar forward-facing stopping surfaces 177, 177' and 178, 178' on the stop members 174, 174' and 176. 176' operably engage with the confronting surface on the front stops 123 whereby halting further movement of the yoke 160 toward the left. In the embodiment shown by way of example in FIGS. 17 and 18, the multiple co-planar forward-facing stopping surfaces 177, 177' and 178, 178' defined by the stop members 174, 174' and 176, 176' allow the second embodiment of the energy absorption/coupling system 120 to travel about 3.5 inches from the neutral position to a full draft position. By halting further movements of the yoke 160, the stop members 174, 174' and 176, 176' ensure against over extension of the cushioning assemblies 180, 180' and limit draft travel while maximizing buff travel and limit total combined travel of the energy absorption coupling system 120 while furthermore preventing inadvertent separation of the railcars and unwarranted braking and/or separation of the air hoses 17 (FIG. 1).

In this second embodiment, the energy absorption/coupling system 120 will have a combined travel in both buff and draft directions of about 10.0 inches. It should be readily appreciated from the above disclosure, however, the travel of the yoke 160 during the draft operation of the energy absorption/coupling system 120 can be modified to change the combined travel in both buff and draft directions to less than 10.0 inches simply by relocating the multiple co-planar inboard-facing stopping surfaces 177, 177' and 178, 178' defined by the stop members 174, 174' and 176, 176' from that disclosed to allow the energy absorption/coupling system 120 to travel a total of less than 10.0 inches by limiting draft travel without detracting or departing from the true spirit and novel concept of this invention disclosure.

From the foregoing, it will be observed that numerous modifications and variations can be made and effected without departing or detracting from the true spirit and novel concept of this invention disclosure. Moreover, it will be appreciated, the present disclosure is intended to set forth exemplifications which are not intended to limit the disclosure to the specific embodiments illustrated. Rather, this disclosure is intended to cover by the appended claims all such modifications and variations as fall within the spirit and scope of the claims.

What is claimed is:

1. A railcar energy absorption/coupling system comprising:

an axially elongated draft sill defining a pocket between front stops and rear stops on said draft sill;

a coupler having a head portion and shank portion, with the head portion of said coupler axially extending beyond an end of said draft sill;

a cushioning assembly for absorbing and returning energy, with said cushioning assembly being positioned in said pocket of said draft sill between said front and rear stops;

a yoke consisting of a back wall, a top wall joined to and axially extending from said back wall toward an open forward end, and a bottom wall joined to and axially extending from said back wall toward the open forward end, with the back wall of said yoke being disposed to contact a rear end of cushioning assembly, and with top and bottom walls of said yoke being operably coupled to the shank portion of said coupler toward the forward end of said yoke;

a coupler follower positioned between a free end of the shank portion of said coupler and a forward end of the cushioning assembly;

with the top and bottom walls of said yoke each having two forward facing stop members located thereon and which extend in opposed lateral directions from each other, with the two forward facing stop members on the top wall of said yoke being arranged generally coplanar with the two forward facing stop members on the bottom wall of said yoke; and wherein said energy absorption/coupling system has a neutral position, a full buff position disposed a first predetermined distance from the neutral position, and full draft position disposed a second predetermined distance from the neutral position, with the rear end of said cushioning assembly being positioned against the rear stops on said draft sill when said energy absorption/coupling system is in the full buff position and with the stop members on said yoke being operably engaged with said forward stops on said sill when the energy absorption/coupling system is in the full draft position.

2. The railcar energy absorption/coupling system according to claim 1, wherein the draft pocket defined by said draft sill has a length of about 24.625 inches between confronting surfaces on the front and rear stops.

3. The railcar energy absorption/coupling system according to claim 1, wherein said coupler follower includes a forward facing surface which is biased into contacting relation with the front stops on said draft sill by said cushioning assembly when the yoke is in the neutral position.

4. The railcar energy absorption/coupling system according to claim 1, wherein the first predetermined distance traveled by said system is generally equal to or greater than the second predetermined distance traveled by said system.

5. The railcar energy absorption/coupling system according to claim 4, wherein said system will have a total combined travel in both buff and draft directions of about 6.5 inches.

6. The railcar energy absorption/coupling system according to claim 1, wherein the stop members on said yoke prevent potential separation of said coupler from said draft sill.

7. The railcar energy absorption/coupling system according to claim 1, wherein the stop members are formed integral with the top and bottom walls on said yoke.

8. The railcar energy absorption/coupling system according to claim 1, wherein said cushioning assembly includes a railcar draft gear assembly including a walled housing.

9. The railcar energy absorption/coupling system according to claim 8, wherein the walled housing of said draft gear assembly has a closed end and an open end.

10. The railcar energy absorption/coupling system according to claim 1, wherein the stop members on said yoke are disposed in generally planar relationship relative to the top and bottom walls on said yoke.

11. A railcar energy absorption/coupling system comprising:

an axially elongated draft sill defining a draft pocket between front stops and rear stops on said draft sill;

a coupler having a head portion and shank portion, with the head portion of said coupler axially extending beyond said draft sill;

a first cushioning assembly arranged in said draft pocket of said draft sill for absorbing and returning energy imparted thereto, a second cushioning assembly arranged in said draft pocket of said draft sill in axially aligned relation with said first cushioning assembly for absorbing and returning energy imparted thereto;

a yoke consisting of a back wall, a top wall joined to and axially extending from said back wall toward open forward end, and a bottom wall joined to and axially extending from said back wall toward the open forward end, with the back wall of said yoke being disposed to contact a rear end of said second cushioning assembly, and with the top and bottom walls of said yoke being operably coupled to the shank portion of said coupler toward a forward end of said yoke;

a front coupler follower positioned between a free end of the shank portion of said coupler and a forward end of the first cushioning assembly;

a rear follower disposed between the rear end of the first cushioning assembly and a forward end of the second cushioning assembly;

with the top and bottom walls of said yoke each having two forward facing stop members which extend in opposed lateral directions from each other, with the two forward facing stop members on the top wall of said yoke being arranged generally coplanar with the two forward facing stop members on the bottom wall of said yoke; and wherein said energy absorption/coupling system has a neutral position, a full buff position disposed a predetermined distance from the neutral position, and full draft position disposed a predetermined distance from the neutral position, with the rear end of said second cushioning assembly being positioned against the rear stops on said draft sill when said energy absorption/coupling system is in the full buff position and with the stop members on said yoke being operably engaged with said front stops when the energy absorption/coupling system is in the full draft position.

12. The railcar energy absorption/coupling system according to claim 11, wherein the draft pocket defined by said draft sill has a length of about 49.25 inches between confronting surfaces on the front and rear stops.

13. The railcar energy absorption/coupling system according to claim 11, wherein said front coupler follower includes a forward facing surface which is biased into contacting relation with the front stops on said draft sill when the energy absorption/coupling system is in the neutral position.

14. The railcar energy absorption/coupling system according to claim 11, wherein said system has a total combined travel in both buff and draft directions of about 10.0 inches.

15. The railcar energy absorption/coupling system according to claim 11, wherein the stop members on said yoke prevent potential separation of said coupler from said draft sill.

16. The railcar energy absorption/coupling system according to claim 11, wherein said first cushioning assembly includes a draft gear assembly including a walled housing.

17. The railcar energy absorption/coupling system according to claim 16, wherein the walled housing of said draft gear assembly has a closed end and an open end.

18. The railcar energy absorption/coupling system according to claim 11, wherein said second cushioning assembly includes a draft gear assembly including a walled housing.

19. The railcar energy absorption/coupling system according to claim 18, wherein the walled housing of said draft gear assembly has a closed end and an open end.

20. The railcar energy absorption/coupling system according to claim 11, wherein the stop members on said yoke are disposed in generally planar relationship relative to the top and bottom walls on said yoke.

21. A railcar energy absorption/coupling system comprising:

an axially elongated draft sill defining a pocket between front stops and rear stops on said draft sill;

a coupler having a head portion and shank portion, with the head portion of said coupler axially extending beyond an end of said draft sill;

a cushioning assembly for absorbing and returning energy, with said cushioning assembly being positioned in said pocket of said draft sill between said front and rear stops, and with said cushioning assembly including a walled housing;

a yoke consisting of a back wall, a top wall joined to and axially extending from said back wall toward an open forward end, and a bottom wall joined to and axially extending from said back wall toward the open forward end, with the back wall of said yoke being disposed to contact a rear end of the housing of said cushioning assembly, with top and bottom walls of said yoke being operably coupled to the shank portion of said coupler toward the forward end of said yoke, and with the top and bottom walls of said yoke embracing the housing of said cushioning assembly therebetween;

a coupler follower positioned between a free end of the shank portion of said coupler and a forward end of the cushioning assembly;

with the top and bottom walls of said yoke each having two forward facing stop members located thereon and which extend in opposed lateral directions from each other, with the two forward facing stop members on the top wall of said yoke being arranged generally coplanar with the two forward facing stop members on the bottom wall of said yoke; and wherein said energy absorption/coupling system has a neutral position, a full buff position disposed a first predetermined distance from the neutral position, and full draft position disposed a second predetermined distance from the neutral position, with the rear end of said cushioning assembly being positioned against the rear stops on said draft sill when said energy absorption/coupling system is in the full buff position and with the stop members on said yoke being operably engaged with said forward stops on said sill when the energy absorption/coupling system is in the full draft position, and wherein draft travel of said energy absorption/coupling system is independently controlled relative to buff travel of said energy absorption/coupling system and is regulated as a function of the location of the four stop members on said yoke.

22. The railcar energy absorption/coupling system according to claim 21, wherein the draft pocket defined by said draft sill has a length of about 24.625 inches between confronting surfaces on the front and rear stops.

23. The railcar energy absorption/coupling system according to claim 21, wherein said coupler follower includes a forward facing surface which is biased into contacting relation with the front stops on said draft sill by said cushioning assembly when the yoke is in the neutral position.

24. The railcar energy absorption/coupling system according to claim 21, wherein the first predetermined distance traveled by said system is generally equal to or greater than the second predetermined distance traveled by said system.

25. The railcar energy absorption/coupling system according to claim 24, wherein said system has a total combined travel in both buff and draft directions of about 6.5 inches.

26. The railcar energy absorption/coupling system according to claim 21, wherein the stop members on said yoke prevent potential separation of said coupler from said draft sill.

27. The railcar energy absorption/coupling system according to claim 21, wherein the stop members are formed integral with the top and bottom walls on said yoke.

28. The railcar energy absorption/coupling system according to claim 21, wherein the walled housing of said cushioning assembly has a closed end and an open end.

29. The railcar energy absorption/coupling system according to claim 21, wherein said yoke is movable relative to the walled housing of said cushioning assembly.

30. The railcar energy absorption/coupling system according to claim 21, wherein the stop members on said yoke are disposed in generally planar relationship relative to the top and bottom walls on said yoke.

31. A railcar energy absorption/coupling system comprising:

an axially elongated draft sill defining a pocket between front stops and rear stops on said draft sill;

a coupler having a head portion and shank portion, with the head portion of said coupler axially extending beyond an end of said draft sill;

a cushioning assembly for absorbing and returning energy;

a yoke consisting of a back wall, a top wall joined to and axially extending from said back wall toward an open forward end, and a bottom wall joined to and axially extending from said back wall toward the open forward end, and with top and bottom walls of said yoke being operably coupled to the shank portion of said coupler toward the forward end of said yoke;

a coupler follower positioned between a free end of the shank portion of said coupler and a forward end of the cushioning assembly;

with the top and bottom walls of said yoke each having two forward facing stop members located thereon and which extend in opposed lateral directions from each other, with the two forward facing stop members on the top wall of said yoke being arranged generally coplanar with the two forward facing stop members on the bottom wall of said yoke; and wherein said energy absorption/coupling system has a neutral position, a full buff position disposed a first predetermined distance from the neutral position, and full draft position disposed a second predetermined distance from the neutral position, and with the stop members on said yoke being operably engaged with said forward stops on said sill when the energy absorption/coupling system is in the full draft position, and wherein draft travel of said energy absorption/coupling system is independently controlled relative to buff travel of said energy absorption/coupling system and is regulated as a function of the location of the four stop members on said yoke.

32. The railcar energy absorption/coupling system according to claim 31, wherein said coupler follower includes a forward facing surface which is biased into contacting relation with the front stops on said draft sill by said cushioning assembly when the yoke is in the neutral position.

33. The railcar energy absorption/coupling system according to claim 31, wherein the first predetermined distance traveled by said system is generally equal to or greater than the second predetermined distance traveled by said system.

34. The railcar energy absorption/coupling system according to claim 31 wherein the stop members on said yoke prevent potential separation of said coupler from said draft sill.

35. The railcar energy absorption/coupling system according to claim 31 wherein the stop members are formed integral with the top and bottom walls on said yoke.

36. The railcar energy absorption/coupling system according to claim 31, wherein the stop members on said yoke are disposed in generally planar relationship relative to the top and bottom walls on said yoke.

* * * * *